US009483900B2

(12) United States Patent
Aoki et al.

(10) Patent No.: US 9,483,900 B2
(45) Date of Patent: Nov. 1, 2016

(54) WAGERING GAME WITH EXPANDING REELS

(71) Applicant: WMS Gaming Inc., Waukegan, IL (US)

(72) Inventors: Dion K. Aoki, Chicago, IL (US); Jeremy M. Hornik, Chicago, IL (US); Daniel P. Louie, Chicago, IL (US); Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 285 days.

(21) Appl. No.: 14/315,754

(22) Filed: Jun. 26, 2014

(65) Prior Publication Data

US 2014/0309015 A1 Oct. 16, 2014

Related U.S. Application Data

(62) Division of application No. 13/654,246, filed on Oct. 17, 2012, now Pat. No. 8,795,059.

(60) Provisional application No. 61/605,045, filed on Feb. 29, 2012, provisional application No. 61/549,610, filed on Oct. 20, 2011.

(51) Int. Cl.
*G07F 17/32* (2006.01)
*G07F 17/34* (2006.01)

(52) U.S. Cl.
CPC ..... *G07F 17/32* (2013.01); *G07F 17/326* (2013.01); *G07F 17/3213* (2013.01); *G07F 17/3244* (2013.01); *G07F 17/34* (2013.01)

(58) Field of Classification Search
CPC .. G07F 17/32; G07F 17/326; G07F 17/3244; G07F 17/3213; G07F 17/34
See application file for complete search history.

(56) References Cited

U.S. PATENT DOCUMENTS

| | | | | |
|---|---|---|---|---|
| 5,364,100 | A | 11/1994 | Ludlow et al. | |
| 5,980,384 | A | 11/1999 | Barrie | |
| 6,086,066 | A | 7/2000 | Takeuchi et al. | |
| 6,227,971 | B1 | 5/2001 | Weiss | |
| 6,280,328 | B1 | 8/2001 | Holch et al. | |
| 6,517,433 | B2 | 2/2003 | Loose et al. | |
| 6,544,120 | B2 * | 4/2003 | Ainsworth | G07F 17/34 273/138.2 |
| 6,644,664 | B2 | 11/2003 | Muir et al. | |
| 6,652,378 | B2 | 11/2003 | Cannon et al. | |
| 6,672,960 | B1 | 1/2004 | B-Jensen | |
| 6,832,957 | B2 | 12/2004 | Falconer | |
| 6,860,810 | B2 | 3/2005 | Cannon et al. | |
| 6,896,615 | B2 | 5/2005 | Berman | |
| 6,932,700 | B2 | 8/2005 | Bennett et al. | |

(Continued)

FOREIGN PATENT DOCUMENTS

| | | |
|---|---|---|
| GB | 2106292 | 4/1983 |
| WO | WO 2007/089410 | 8/2007 |

*Primary Examiner* — Dmitry Suhol
*Assistant Examiner* — David Duffy
(74) *Attorney, Agent, or Firm* — Nixon Peabody LLP

(57) ABSTRACT

A method for conducting a wagering game includes receiving a wager to play the wagering game. A base array of symbol positions arranged in a plurality of columns is displayed. A plurality of symbols is randomly distributed such that each of the symbol positions in the base array is associated with one or more of the symbols. An extent by which the base array of symbol positions is to be expanded is indicated by the symbols. The base array of symbol positions is expanded into an expanded array of symbol positions including at least one additional symbol position.

25 Claims, 18 Drawing Sheets

(56) References Cited

U.S. PATENT DOCUMENTS

| | | | | |
|---|---|---|---|---|
| 7,252,591 | B2 | 8/2007 | Van Asdale | |
| 7,402,102 | B2 | 7/2008 | Marks et al. | |
| 7,410,420 | B2 | 8/2008 | Shiraishi | |
| 7,594,851 | B2 | 9/2009 | Falconer | |
| 7,611,406 | B2 | 11/2009 | Fuller | |
| 7,654,895 | B2 | 2/2010 | Pacey | |
| 7,874,910 | B2 | 1/2011 | Berman | |
| 7,927,204 | B2 | 4/2011 | DeBrabander et al. | |
| 8,105,145 | B2 * | 1/2012 | Jaffe | G07F 17/3265 273/143 R |
| 8,287,358 | B2 * | 10/2012 | Aoki | G07F 17/34 463/16 |
| 8,292,724 | B2 * | 10/2012 | Marks | G07F 17/3227 463/16 |
| 8,419,519 | B2 * | 4/2013 | Aoki | 463/16 |
| 8,460,089 | B2 * | 6/2013 | Pires | G07F 17/32 438/24 |
| 8,602,868 | B2 * | 12/2013 | Johnson | G07F 17/3213 463/20 |
| 8,616,953 | B2 | 12/2013 | Yi | |
| 9,214,066 | B2 * | 12/2015 | Collette | G07F 17/326 |
| 9,330,527 | B2 * | 5/2016 | Collette | G07F 17/3213 |
| 2003/0045354 | A1 | 3/2003 | Giobbi | |
| 2004/0023714 | A1 | 2/2004 | Asdale | |
| 2004/0242313 | A1 | 12/2004 | Munoz | |
| 2005/0096113 | A1 | 5/2005 | Gabuchian | |
| 2005/0159208 | A1 | 7/2005 | Pacey | |
| 2006/0079313 | A1 | 4/2006 | Trainor et al. | |
| 2006/0247002 | A1 | 11/2006 | Yoshimi et al. | |
| 2008/0070672 | A1 | 3/2008 | Inamura | |
| 2008/0287178 | A1 | 11/2008 | Berman et al. | |
| 2011/0244943 | A1 | 10/2011 | Milford et al. | |
| 2012/0309498 | A1 | 12/2012 | O'Halloran | |
| 2012/0322535 | A1 * | 12/2012 | Englman | G07F 17/34 463/20 |
| 2013/0065663 | A1 * | 3/2013 | Johnson | G07F 17/3213 463/20 |
| 2013/0157741 | A1 | 6/2013 | Pacey et al. | |
| 2013/0252711 | A1 * | 9/2013 | Dias Pires | G07F 17/32 463/21 |

* cited by examiner

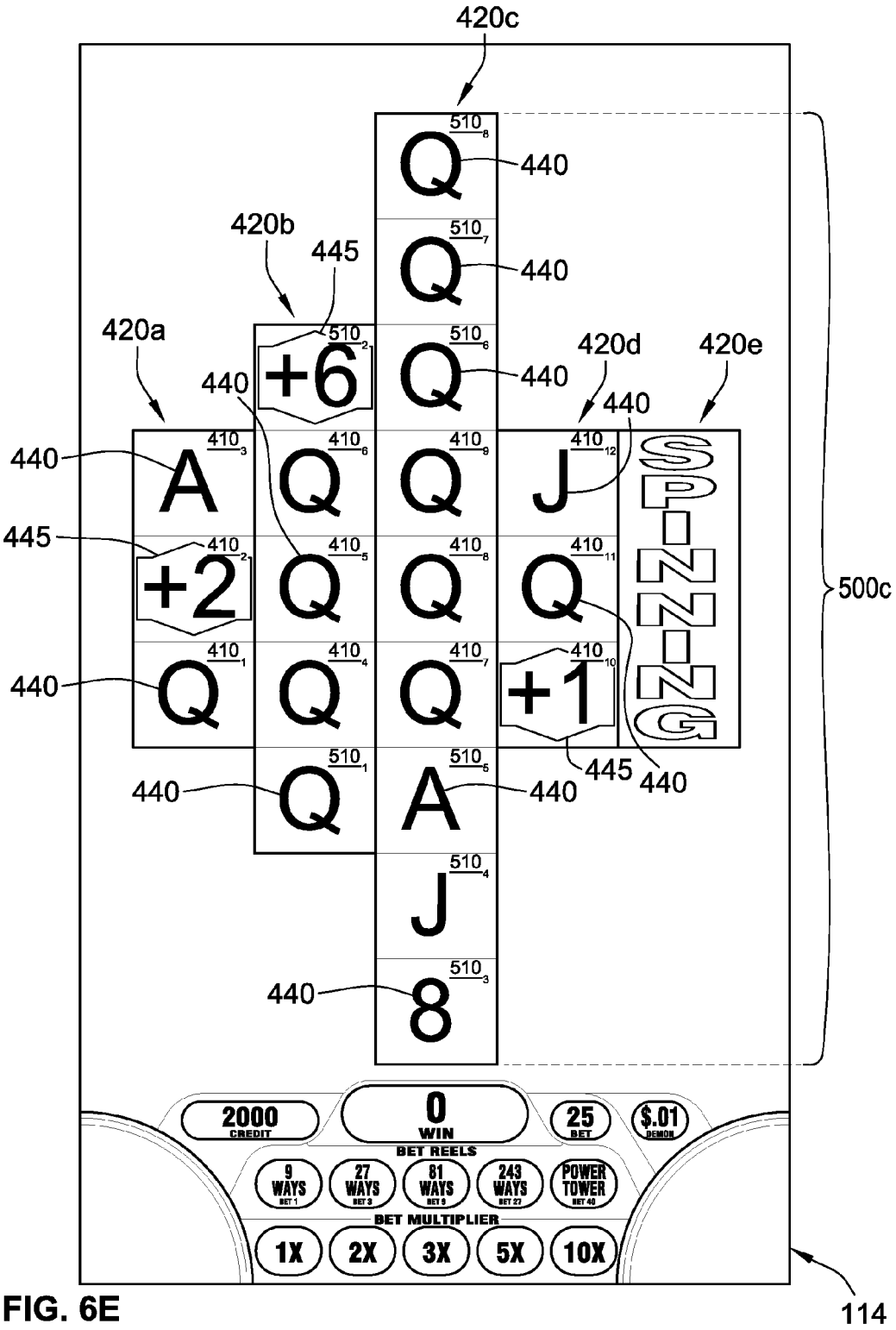
420c
420b
445
420a
440
420d
420e
445
500c
445
440
445
440
440
440

WAGERING GAME WITH EXPANDING REELS

CROSS-REFERENCE TO RELATED APPLICATION

This application is a divisional of prior application Ser. No. 13/654,246, filed Oct. 17, 2012, now U.S. Pat. No. 8,795,059, which claims the benefit of U.S. Provisional Application No. 61/605,045, filed Feb. 29, 2012, and 61/549,610, filed Oct. 20, 2011, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering game machines and, more particularly, to wagering game machines with expanding reels.

BACKGROUND OF THE INVENTION

Gaming machines or terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing terminals and the expectation of winning each terminal is roughly the same (or believed to be the same), players are most likely to be attracted to the more entertaining and exciting terminal. As a result, wagering game machine operators strive to employ the most entertaining and exciting machines available, because such machines attract frequent play and provide increased profitability for the operators.

SUMMARY OF THE INVENTION

A method for conducting a wagering game includes receiving, via an input device, a wager to play the wagering game. A base array of symbol positions arranged in a plurality of columns is displayed on one or more display devices. A plurality of symbols is randomly distributed such that each of the symbol positions in the base array of symbol positions is associated with one or more of the plurality of symbols. An extent by which the base array of symbol positions is to be expanded is indicated by one or more of the plurality of symbols. The base array of symbol positions is expanded into an expanded array of symbol positions. The expanded array of symbol positions includes at least one additional symbol position. The expanded array of symbol positions is displayed on the one or more display devices.

A method for conducting a wagering game on a gaming terminal includes receiving, via an input device, a wager to play the wagering game. A base array of symbol positions arranged in a plurality of columns is displayed on one or more display devices. A plurality of symbols is randomly distributed among the base array of symbol positions such that each of the symbol positions is associated with one of the plurality of symbols. One of the randomly distributed symbols is a reel-expansion symbol that bears a number. An extent by which the base array of symbol positions is to be expanded is indicted by the number of the reel-expansion symbol. The base array of symbol positions is expanded into an expanded array of symbol positions. The expanded array of symbol positions includes at least one additional symbol position. The expanded array of symbol positions is displayed on the one or more display devices.

A method for conducting a wagering game on a gaming terminal includes receiving, via an input device, a wager to play the wagering game. A base array of symbol positions arranged in a plurality of columns is displayed on one or more display devices. A plurality of symbols is randomly distributed among the base array of symbol positions such that each of the symbol positions is associated with one or more of the plurality of symbols. In response to one of the symbol positions being associated with two or more of the plurality of symbols and is thereby a multi-symbol position, the base array of symbol positions is expanded into an expanded array of symbol positions. The expanded array of symbol positions includes at least one additional symbol position. The two or more of the plurality of symbols associated with the multi-symbol position are redistributed such that the multi-symbol position and the at least one additional symbol position are each associated with exactly one symbol. The expanded array of symbol positions is displayed on the one or more display devices.

A system for conducting a wagering game includes at least one input device configured to receive a wager to play the wagering game and at least one display configured to display a base array of symbol positions arranged in a plurality of columns. The system further includes at least one processor configured to randomly distribute a plurality of symbols such that each of the symbol positions in the base array of symbol positions is associated with one or more of the plurality of symbols. In response to one or more of the plurality of symbols indicating an expansion feature, the display is configured to display an expanded array of symbol positions. The expanded array of symbol positions includes at least one additional symbol position. The one or more of the plurality of symbols indicates an extent by which the base array of symbol positions is to be expanded.

A method for conducting a wagering game via a gaming terminal includes receiving, via an input device, a wager to play the wagering game. A base array of symbol positions arranged in a plurality of columns is displayed on one or more display devices. A plurality of symbols is randomly distributed such that each of the symbol positions in the base array of symbol positions is associated with one of the plurality of symbols. The base array of symbol positions is expanded into an expanded array of symbol positions by expanding one of the columns to include one or more additional symbol positions. A duplicated symbol associated with one of the symbol positions is distributed into the one or more additional symbol positions such that the expanded column contains a clump of the duplicated symbol. The expanded array of symbol positions is displayed on the one or more display devices.

A method for conducting a wagering game via a gaming terminal includes receiving, via an input device, a wager to play the wagering game. A base array of symbol positions arranged in a plurality of columns is displayed on one or more display devices. A plurality of symbols is randomly distributed such that each of the symbol positions in the base array of symbol positions is associated with one of the plurality of symbols. The base array of symbol positions is expanded into an expanded array of symbol positions by expanding at least one of the columns to include one or more additional symbol positions. For each expanded column, each of the one or more additional symbol positions is populated with a duplicated symbol that is associated with one of the symbol positions of the respective expanded column such that the expanded column contains a clump of the duplicated symbol. The expanded array of symbol positions is displayed on the one or more display devices.

Additional aspects of the present disclosure will be apparent to those of ordinary skill in the art in view of the detailed description of various implementations, which is made with reference to the drawings, a brief description of which is provided below.

BRIEF DESCRIPTION OF THE DRAWINGS

FIGS. 4, 5A-5C, and 6A-6G are screen shots of a display of the free-standing gaming terminal of FIG. 3 according to various aspects of the present disclosure.

Figure 1:
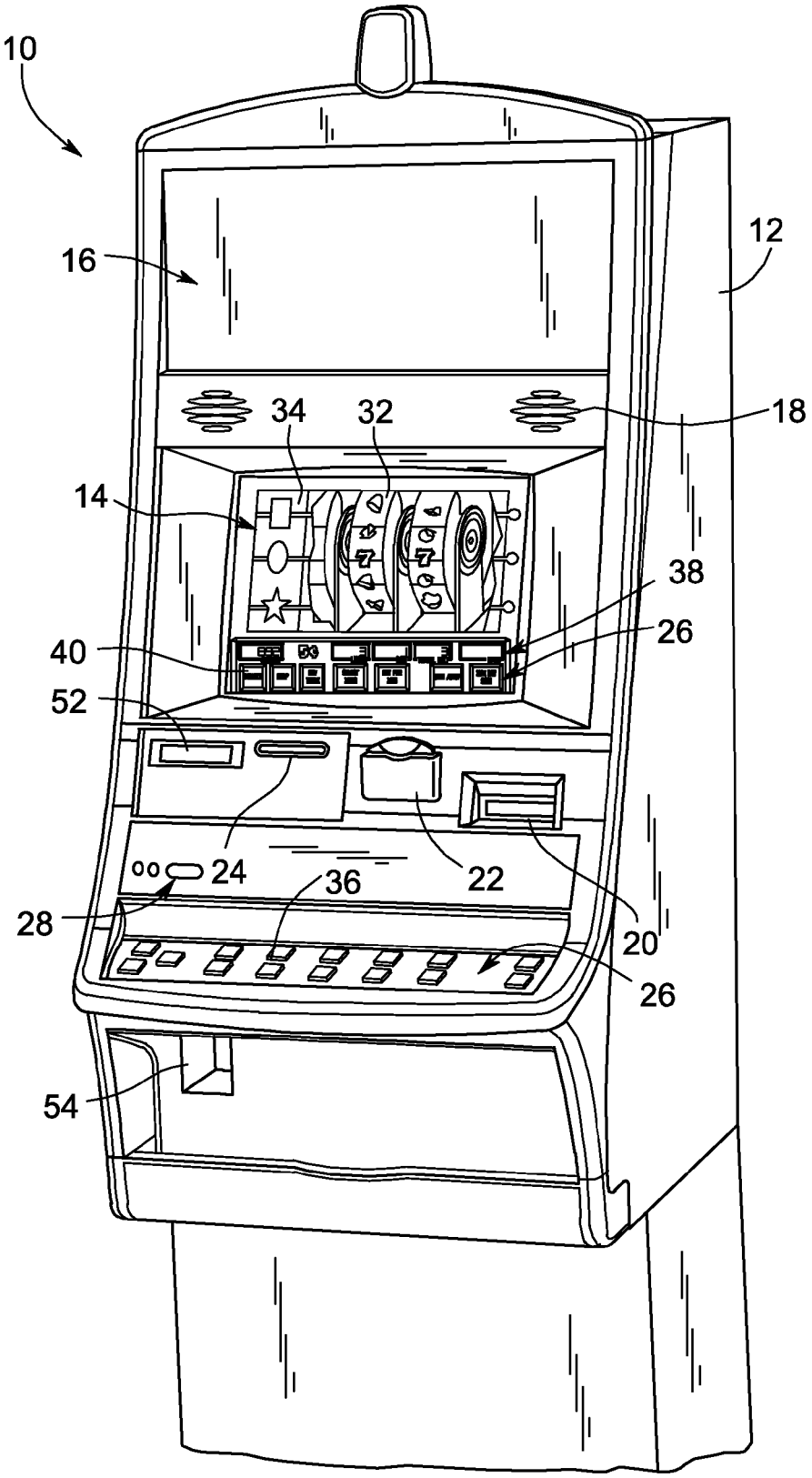
FIG. 1 is a perspective view of a free-standing gaming terminal according to an embodiment of the present disclosure.

While the present disclosure is susceptible to various modifications and alternative forms, specific implementations have been shown by way of example in the drawings and will be described in detail herein. It should be understood, however, that the present disclosure is not intended to be limited to the particular forms disclosed. Rather, the disclosure is to cover all modifications, equivalents, and alternatives falling within the spirit and scope of the present invention as defined by the appended claims.

DETAILED DESCRIPTION

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 26, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 includes, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354 entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
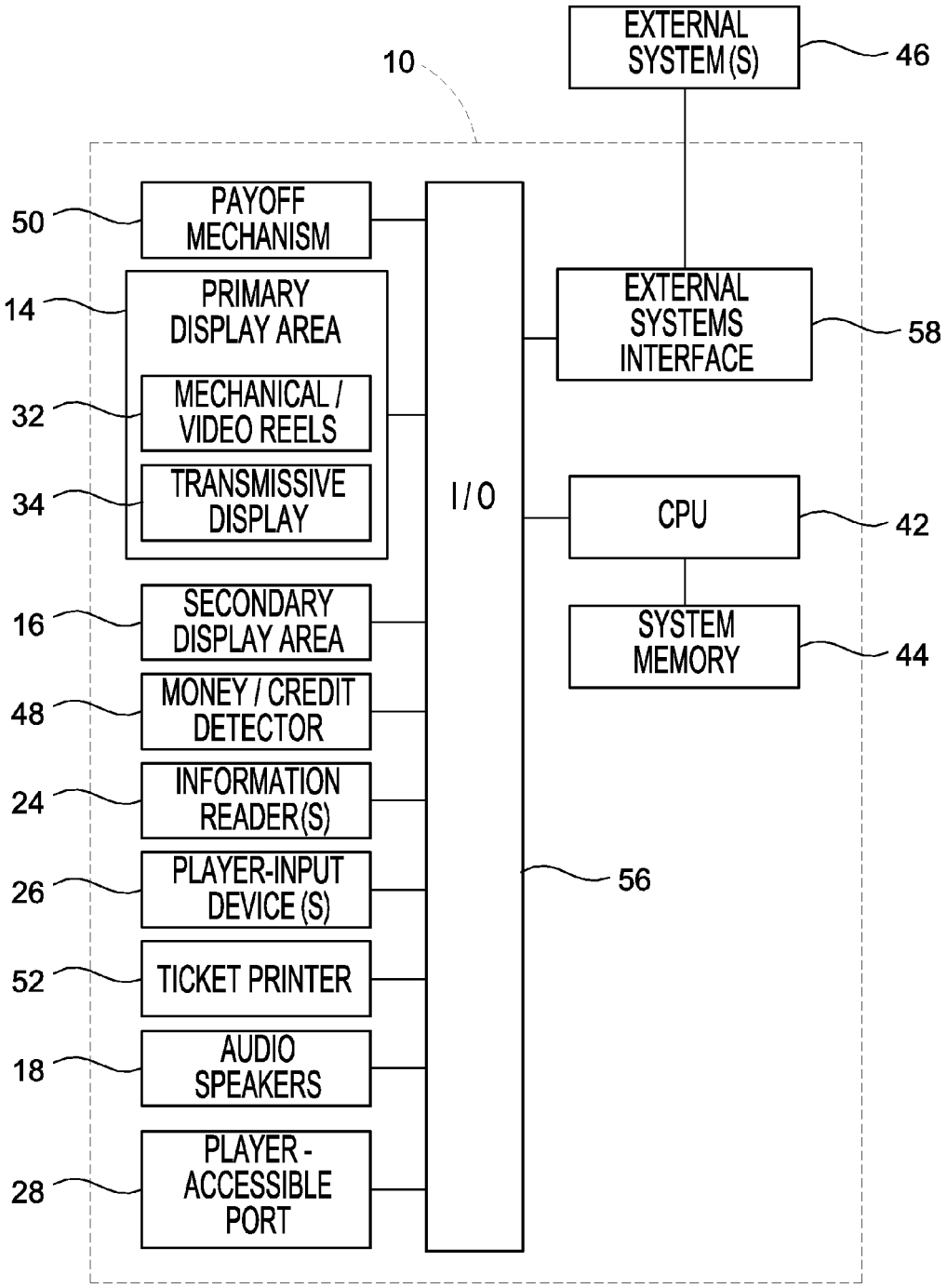
FIG. 2 is a schematic view of a gaming system according to an embodiment of the present disclosure.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
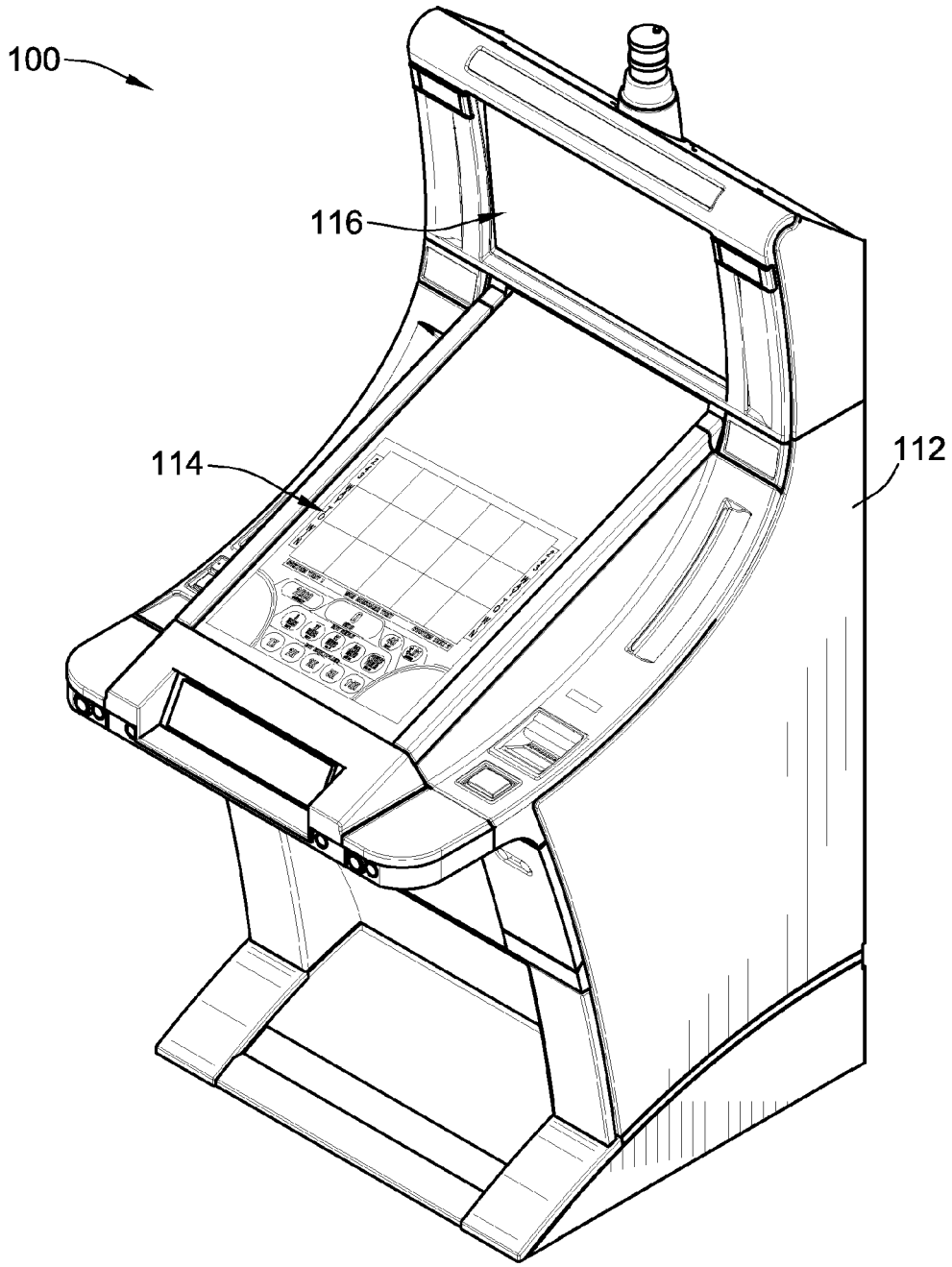
FIG. 3 is a perspective view of a free-standing gaming terminal according to an embodiment of the present disclosure.

Referring to FIG. 3, a gaming terminal or machine 100 includes a gaming cabinet or housing 112, a primary display area 114, and a secondary display area 116, which are similar to the cabinet 12, the primary display area 14, and the secondary display area 16, respectively, discussed above in reference to FIGS. 1 and 2. The gaming cabinet 112 can have a variety of external shapes and sizes to contain the necessary electronic components used in conducting a wagering game.

Figure 4:
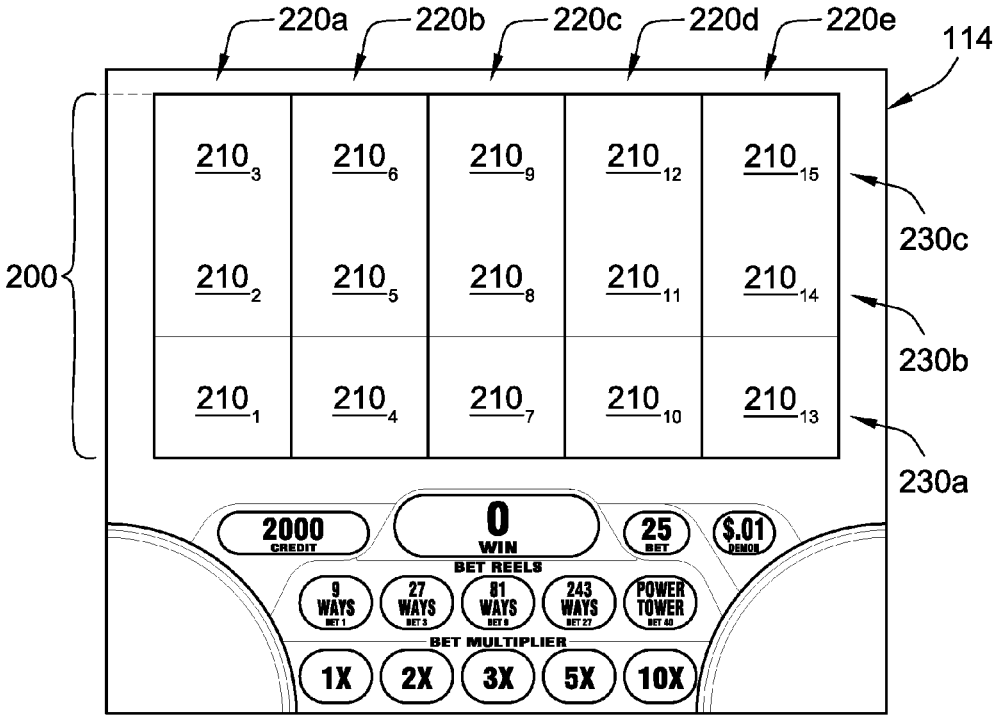

The primary display area 114 and/or the secondary display area 116 can be used for displaying one or more portions of a wagering game. Referring to FIG. 4, a screen shot from the primary display area 114 illustrates a base array of symbol positions 200 used in conducting a wagering game (in FIG. 4, no symbols are shown in the symbol positions $\mathbf{210}_{1\text{-}15}$ for ease of illustration). Specifically, the base array of symbol positions 200 is a 3×5 matrix of symbol positions $\mathbf{210}_{1\text{-}15}$ arranged in five columns 220*a-e* and three rows 230*a-c* (i.e., 15 symbol positions $\mathbf{210}_{1\text{-}15}$).

The base array of symbol positions 200 is formed by a plurality of symbol-bearing reels such that each of the columns 220*a-e* is occupied by a single one of the reels and each of the reels bears a plurality of symbols. The symbol bearing reels can be mechanical reels, displayed simulated reels, or a combination thereof. While the gaming terminal 100 conducts a play of the wagering game, each of the columns 220*a-e*, or each of the symbol-bearing reels, spins or illustrates a simulated spin to appear as if each of the columns 220*a-e* is spinning prior to displaying an outcome. At the beginning of a play of the wagering game, all of the columns 220*a-e* spin and then stop spinning sequentially left to right (i.e., the first column 220*a* stops spinning first and displays its outcome, then the second column 220*b* stops and displays its outcome, etc.).

Figure 5A:
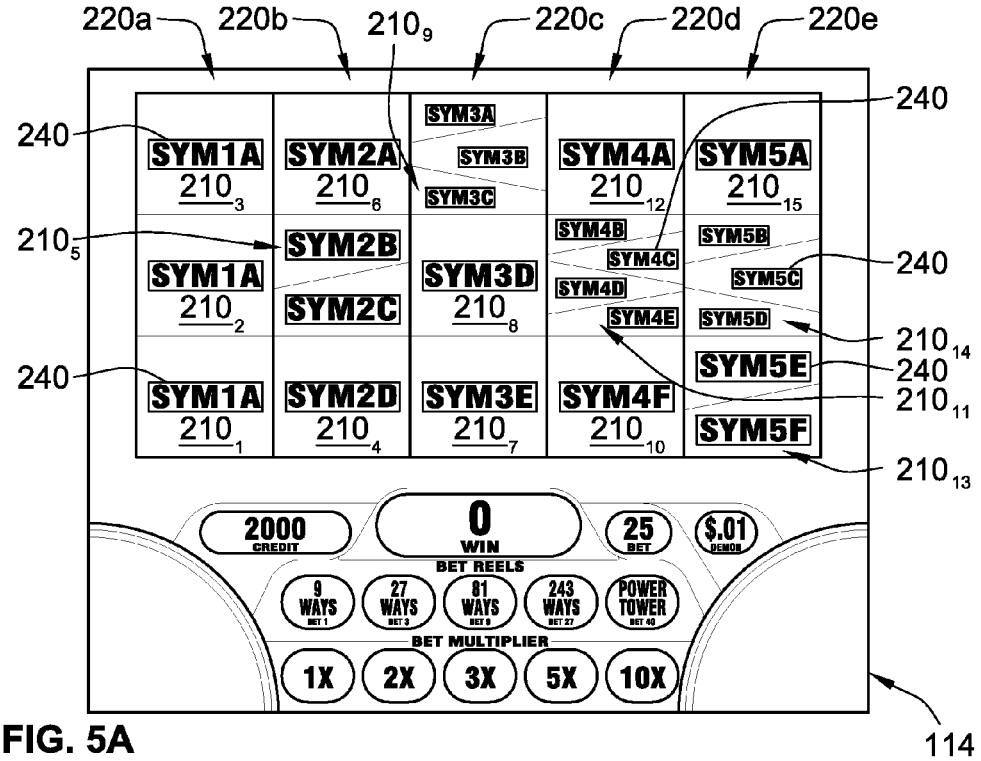

As each column 220*a-e* stops spinning, a portion of a randomly distributed outcome of symbols is displayed on the primary display area 114. Referring to FIG. 5A, an entire outcome of a wagering game is illustrated as each of the symbol positions $\mathbf{210}_{1\text{-}15}$ is associated with one or more symbols 240. Symbol positions $\mathbf{210}_5$, $\mathbf{210}_9$, $\mathbf{210}_{11}$, $\mathbf{210}_{13}$, and $\mathbf{210}_{14}$ are each associated with two or more symbols 240 and are thereby multi-symbol positions. For example, multi-symbol position $\mathbf{210}_5$ is associated with two symbols (SYM2B and SYM2C). SYM2B and SYM2C can be the same or different symbols 240. For another example, multi-symbol position $\mathbf{210}_{14}$ is associated with three symbols (SYM5B, SYM5C, and SYM5D), which can be the same and/or different symbols.

When an outcome of the wagering game includes one or more multi-symbol positions (e.g., multi-symbol position $\mathbf{210}_5$), such as the outcome displayed in FIG. 5A, the base array of symbol positions 200 expands into an expanded array of symbol positions 300 (FIG. 5B) to include one or more additional symbol positions $\mathbf{310}_{1\text{-}9}$. The number of symbols 240 associated with each of the multi-symbol positions $\mathbf{210}_5$, $\mathbf{210}_9$, $\mathbf{210}_{11}$, $\mathbf{210}_{13}$, and $\mathbf{210}_{14}$ (FIG. 5A) indicates an extent by which the base array of symbol positions 200 is to be expanded into the expanded array of symbol positions 300 (FIG. 5B).

For example, the multi-symbol position $\mathbf{210}_5$ (FIG. 5A) is associated with two symbols 240 (SYM3B and SYM2C), which indicate that the base array of symbol positions 200 is to be expanded to include at least one additional symbol position to provide a space for the extra symbol (e.g., SYM2C) in the multi-symbol position $\mathbf{210}_5$. The total number of additional symbol positions added to the base array of symbol position 200 (FIG. 5A) to create the expanded array of symbol positions 300 (FIG. 5B) is based on the number of symbols in all of the multi-symbol positions included in the base array of symbol positions 200. In the illustrated example of FIGS. 5A and 5B, the number of extra symbols in the multi-symbol positions $\mathbf{210}_5$, $\mathbf{210}_9$, $\mathbf{210}_{11}$, $\mathbf{210}_{13}$, and $\mathbf{210}_{14}$ (FIG. 5A) is nine, thus, the expanded array of symbol positions 300 includes nine additional symbol positions $\mathbf{310}_{1\text{-}9}$ (FIG. 5B).

The expanding of the base array of symbol positions 200 (FIG. 5A) into the expanded array of symbol positions 300 (FIG. 5B) can occur at any time during play of the wagering game when one of the symbol positions $\mathbf{210}_{1\text{-}15}$ is randomly associated with two or more symbols 240 and is thereby a multi-symbol position. For example, after all of the columns 220*a-e* stop spinning and the complete outcome of a play of the wagering game is displayed, if one or more of the symbol positions $\mathbf{210}_{1\text{-}15}$ is a multi-symbol position, the base array of symbol positions 200 expands to include at least one additional symbol position. Alternatively, after one column stops spinning and includes a multi-symbol position, that column can expand prior to the rest of the columns stopping to spin.

Figure 5B:
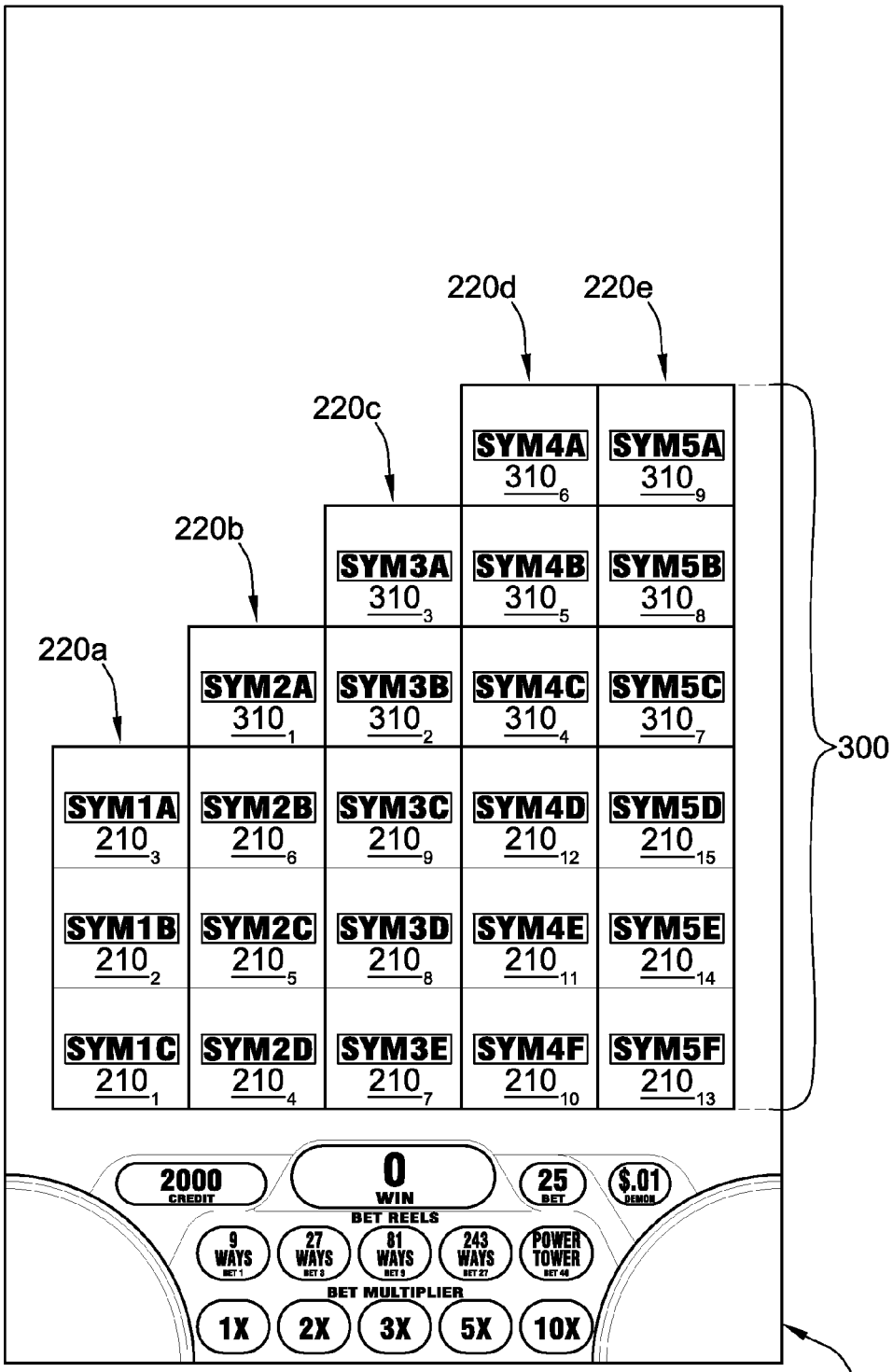

As shown in FIG. 5B, the base array of symbol positions 200 expanded into the expanded array of symbol positions 300 such that each column containing one of the multi-symbol positions (i.e., symbol positions $\mathbf{210}_5$, $\mathbf{210}_9$, $\mathbf{210}_{11}$, $\mathbf{210}_{13}$, and $\mathbf{210}_{14}$) increased in height to include at least one additional symbol position. Specifically, in the base array of symbol positions 200 (FIG. 5A), the second column 220*b* included multi-symbol position $\mathbf{210}_5$, which was associated with two symbols 240 (FIG. 5A), and in the expanded array of symbol positions 300 (FIG. 5B), the second column 220*b* increased in height to include one additional symbol position $\mathbf{310}_1$. Similarly, in the base array of symbol positions 200 (FIG. 5A), the third column 220*c* included multi-symbol position $\mathbf{210}_9$, which was associated with three symbols 240 (FIG. 5A), and in the expanded array of symbol positions 300 (FIG. 5B), the third column 220*c* increased in height to include two additional symbol positions $\mathbf{310}_{2\text{-}3}$; in the base array of symbol positions 200 (FIG. 5A), the fourth column 220*d* included multi-symbol position $\mathbf{210}_{11}$, which was associated with four symbols 240 (FIG. 5A), and in the expanded array of symbol positions 300 (FIG. 5B), the fourth column 220*d* increased in height to include three additional symbol positions $\mathbf{310}_{4\text{-}6}$; and in the base array of symbol positions 200 (FIG. 5A), the fifth column 220*e* included multi-symbol positions $\mathbf{210}_{13}$ and $\mathbf{210}_{14}$, which were associated with two and three symbols 240 (FIG. 5A), respectively, and in the expanded array of symbol positions 300 (FIG. 5B), the fifth column 220*d* increased in height to include three additional symbol positions $\mathbf{310}_{7\text{-}9}$.

In addition to the expanding of the base array of symbol positions 200 (FIG. 5A) to include the additional symbol positions $\mathbf{310}_{1\text{-}9}$, the symbols 240 are redistributed among the expanded array of symbol positions 300. Specifically, the symbols 240 that were originally associated with the symbol positions $\mathbf{210}_{1\text{-}15}$ in the base array of symbol positions 200 (FIG. 5A) are redistributed among the symbol positions $\mathbf{210}_{1\text{-}15}$ and the additional symbol positions $\mathbf{310}_{1\text{-}9}$ in the expanded array of symbol positions 300 (FIG. 5B). The symbols 240 are redistributed such that each of the symbol positions $\mathbf{210}_{1\text{-}15}$ and the additional symbol positions $\mathbf{310}_{1\text{-}9}$ is associated with exactly one symbol 240 in the expanded array of symbol positions 300 (FIG. 5B).

For example, in the base array of symbol positions 200 (FIG. 5A), the second column 220*b* included symbol positions $\mathbf{210}_{4\ and\ 6}$, which were each associated with one symbol 240, and multi-symbol position $\mathbf{210}_5$, which was associated with two symbols 240 (FIG. 5A). In the expanded array of symbol positions 300 (FIG. 5B), the second column 220*b* increased in height to include one additional symbol position $\mathbf{310}_1$, and the symbols 240 were redistributed such that the symbol 240 (SYM2D) in the symbol position $\mathbf{210}_4$ remained in the same symbol position $\mathbf{210}_4$, one of the symbols (SYM2C) associated with the multi-symbol position $\mathbf{210}_5$ remained in the symbol position $\mathbf{210}_5$, the other of the symbols 240 (SYM2B) associated with the multi-symbol position $\mathbf{210}_5$ moved into the symbol position $\mathbf{210}_6$ (i.e., was redistributed), and the symbol 240 (SYM2A) associated with the symbol position $\mathbf{210}_6$ moved into the additional symbol position $\mathbf{310}_1$ (i.e., was redistributed).

The redistribution of the symbols in a particular column can occur at any time during the play of the wagering game. For example, all of the multi-symbol positions can be redistributed together after all of the columns expand into the expanded array of symbol positions 300. Alternatively, the first column including a multi-symbol position can expand and then redistribute the symbols contained in the column prior to the next column including a multi-symbol position.

Alternatively to the symbols 240 being redistributed within the same column as shown in FIG. 5B, the symbols 240 in a multi-symbol position (e.g., multi-symbol position $\mathbf{210}_5$ in FIG. 5A) can be redistributed among any of the additional symbol positions $\mathbf{310}_{1\text{-}9}$ or any of the other symbol positions $\mathbf{210}_{1\text{-}15}$. For example, instead of the symbol 240 (SYM2B) being moved from symbol position $\mathbf{210}_5$ into symbol position $\mathbf{210}_6$, during redistribution, the symbol 240 (SYM2B) can be moved into additional symbol position $\mathbf{310}_2$ in the third column 220*c* (not shown).

After the symbols 240 are redistributed among the expanded array of symbol positions 300, the outcome is evaluated to determine if it is a winning outcome. If a winning outcome is determined, an award is provided to the player of the wagering game (e.g., credits or money). The amount of the provided award is based on a value associated with the winning outcome in a pay table. The outcome of the wagering game can correspond with more than one winning outcome in the pay table and is thereby a multi-winning outcome. In the case of a multi-winning outcome, the amount of the provided award is based on the winning outcome having the largest associated award in the pay table. Alternatively, the amount of the provided award can be the sum (or a percentage thereof) of the awards associated with each of the winning outcomes in the multi-winning outcome.

As the expanded array of symbol positions 300 (FIG. 5B) includes more symbol positions than the base array of symbol positions 200 (FIG. 5A), the expanded array of symbol positions 300 has more ways for a player of the wagering game to win the wagering game and thus provides added excitement to the player. For example, the base array of symbol positions 200 includes 5 columns 220*a-e* with three symbol positions 210 in each column, which has two hundred and forty-three ways to win (3×3×3×3×3=243), assuming a winning outcome must start from the leftmost column 220*a* and must include a single symbol from each of the columns 220*a-e*. However, the expanded array of symbol positions 300 includes 5 columns 220*a-e* with three symbol positions $\mathbf{210}_{1\text{-}3}$ in the first column 220*a*, four symbol positions $\mathbf{210}_{4\text{-}6}$, $\mathbf{310}_1$ in the second column 220*b*, five symbol positions $\mathbf{210}_{7\text{-}9}$, $\mathbf{310}_{2\text{-}3}$ in the third column 220*c*, six symbol positions $\mathbf{210}_{10\text{-}12}$, $\mathbf{310}_{4\text{-}6}$ in the fourth column 220*d*, and six symbol positions $\mathbf{210}_{13\text{-}15}$, $\mathbf{310}_{7\text{-}9}$ in the fifth column 220*e*, which has two thousand one hundred sixty ways to win (3×4×5×6×6=2160)), assuming again a winning outcome must start from the leftmost column 220*a* and must include a single symbol from each of the columns 220*a-e*.

Referring generally to FIGS. 4-5B, a method of conducting a wagering game according to aspects of the present disclosure includes receiving a wager to play the wagering game. The wager can be received via one or more input devices, such as, for example, a card reader or money acceptor. After the wager is received, the gaming terminal 100 displays the base array of symbol positions 200 arranged in the plurality of columns 220*a-e*. The base array of symbol positions 200 can be displayed on the primary display 114 (as shown in FIG. 4), the secondary display 116 (not shown), or a combination thereof (not shown).

A plurality of symbols 240 are then randomly distributed among the base array of symbol positions 200 such that each of the symbol positions $\mathbf{210}_{1\text{-}15}$ is associated with one or more of the plurality of symbols 240. The random distribution can be performed by a random number generator and/or one or more processors. In response to one of the symbol positions $\mathbf{210}_{1\text{-}15}$ being associated with two or more of the plurality of symbols 240 and is thereby a multi-symbol position (e.g., multi-symbol position $\mathbf{210}_5$), the base array of symbol positions 200 (FIG. 5A) is expanded into the expanded array of symbol positions 300 (FIG. 5B), which includes the additional symbol positions $\mathbf{310}_{1\text{-}9}$.

The symbols 240 associated with the multi-symbol positions are redistributed as described above. Then, the expanded array of symbol positions 300 is displayed such that each symbol position in the expanded array of symbol positions 300 is associated with a single symbol 240 (e.g., each symbol position contains exactly one symbol therein). A symbol 240 is defined herein as an indicia appearing on the pay table of the wagering game as an element of a potential winning outcome.

Figure 5C:
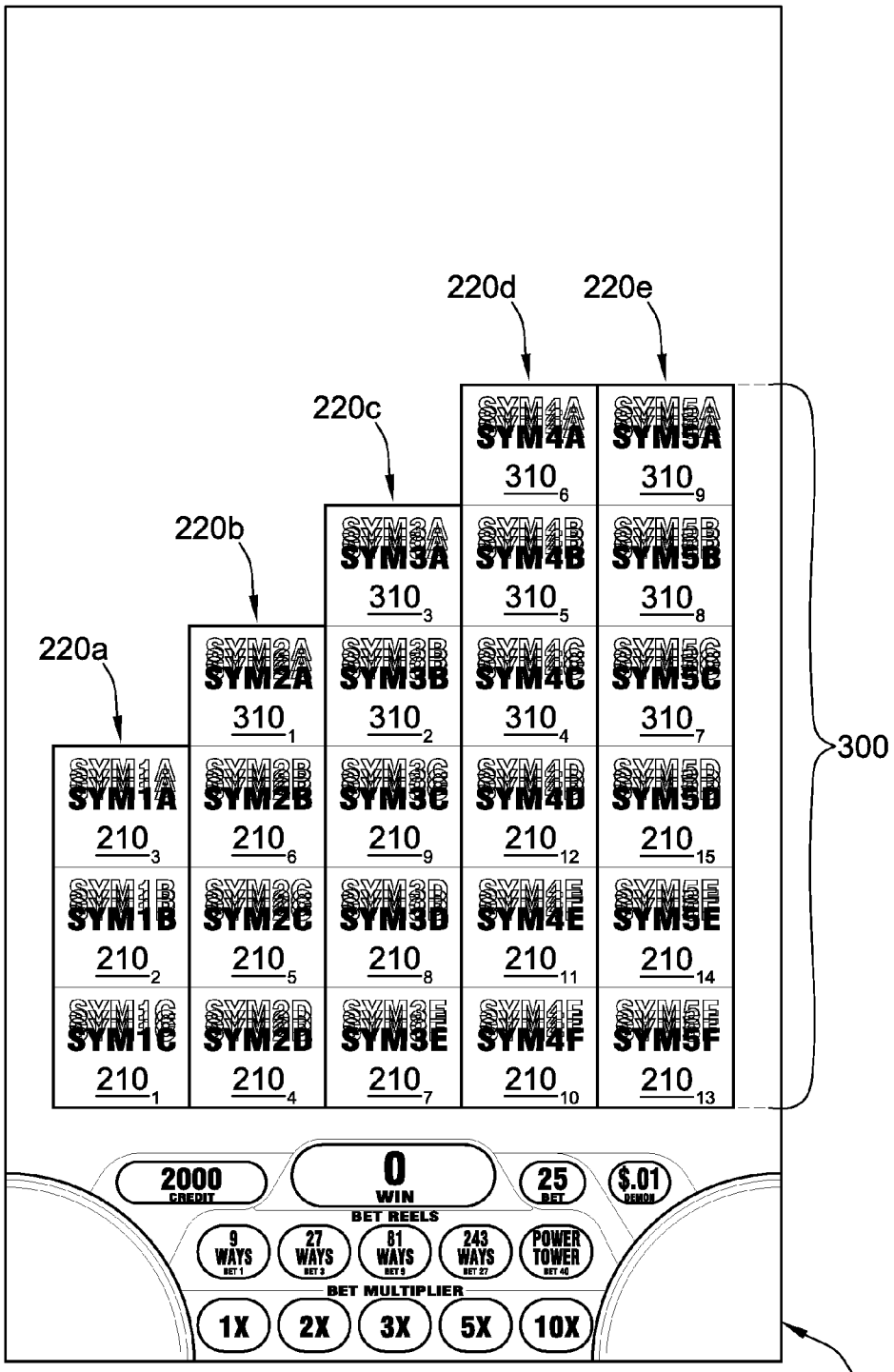
Figure 6A:
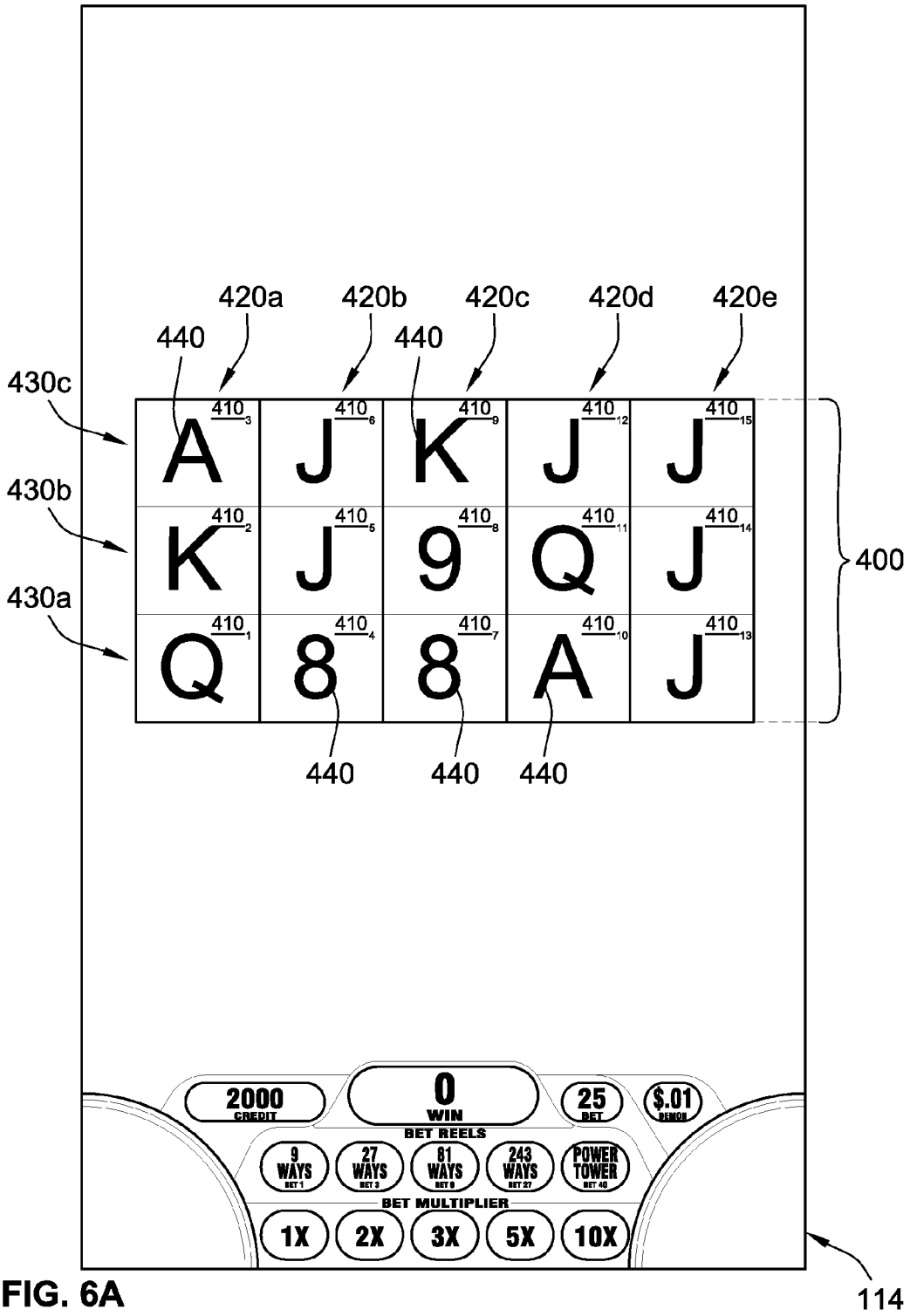

In accordance with an alternative implementation, referring generally to FIGS. 6A-6G, various screen shots from the primary display area 114 illustrate various arrays of symbol positions used in conducting a wagering game. Referring to FIG. 6A, a base array of symbol positions 400 is a 3×5 matrix of symbol positions $\mathbf{410}_{1\text{-}15}$ arranged in five columns 420*a-e* and three rows 430*a-c* (i.e., 15 symbol positions $\mathbf{410}_{1\text{-}15}$), in the same, or similar, fashion as the base array of symbol positions 200, described above in reference to FIGS. 4-5B.

Figure 6B:
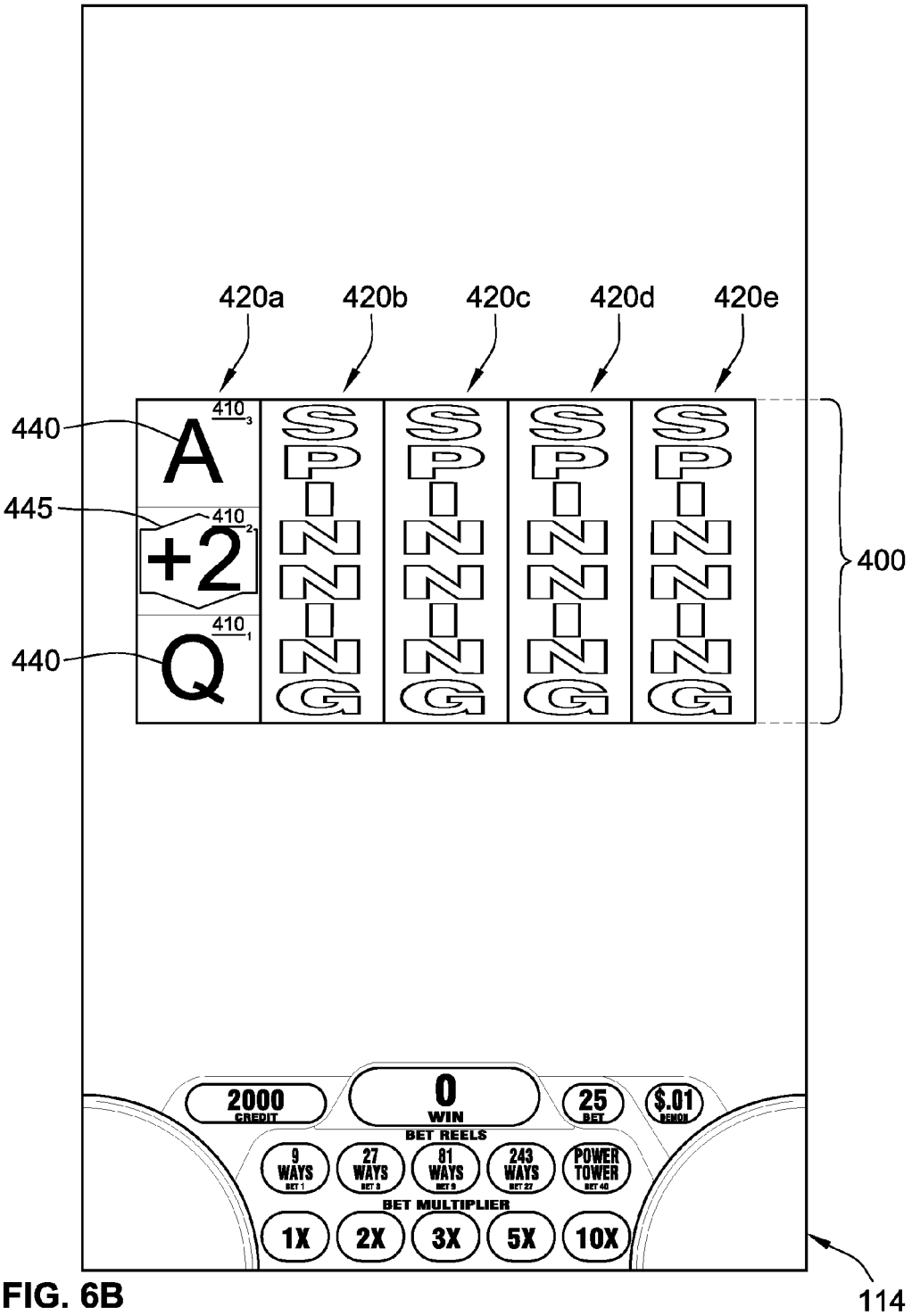

During play of the wagering game, as each column 420*a-e* stops spinning, a portion of a randomly distributed outcome of symbols is displayed on the primary display area 114. An entire outcome of a wagering game is illustrated in FIG. 6A as each of the symbol positions $\mathbf{410}_{1\text{-}15}$ is associated with a symbol 440. Referring to FIG. 6B, a screen shot of the middle of a play of the wagering game is shown as the first column 420*a* has stopped spinning and its randomly distributed outcome is displayed while the remaining columns 420*b-e* remain spinning. The randomly distributed outcome of the first column 420*a* includes two basic symbols 440 and one reel-expansion symbol 445. The two basic symbols 440 are associated with the first and third symbol positions $\mathbf{410}_1$ and $\mathbf{410}_3$, respectively. The reel-expansion symbol 445 is associated with the second symbol position $\mathbf{410}_2$.

The reel-expansion symbol 445 indicates an extent by which the base array of symbol positions 400 (FIG. 6B) is to be expanded. The reel-expansion symbol 445 associated with the second symbol position $\mathbf{410}_2$ indicates that the base array of symbol positions 400 is to be expanded by two additional symbol positions as the symbol 445 bears a "+2" indicia. The indicia of the reel-expansion symbol 445 is a numerical number with a plus sign; however, the indicia can be a number spelled out in text, such as, "two," "plus two," "+two," etc.

Figure 6C:
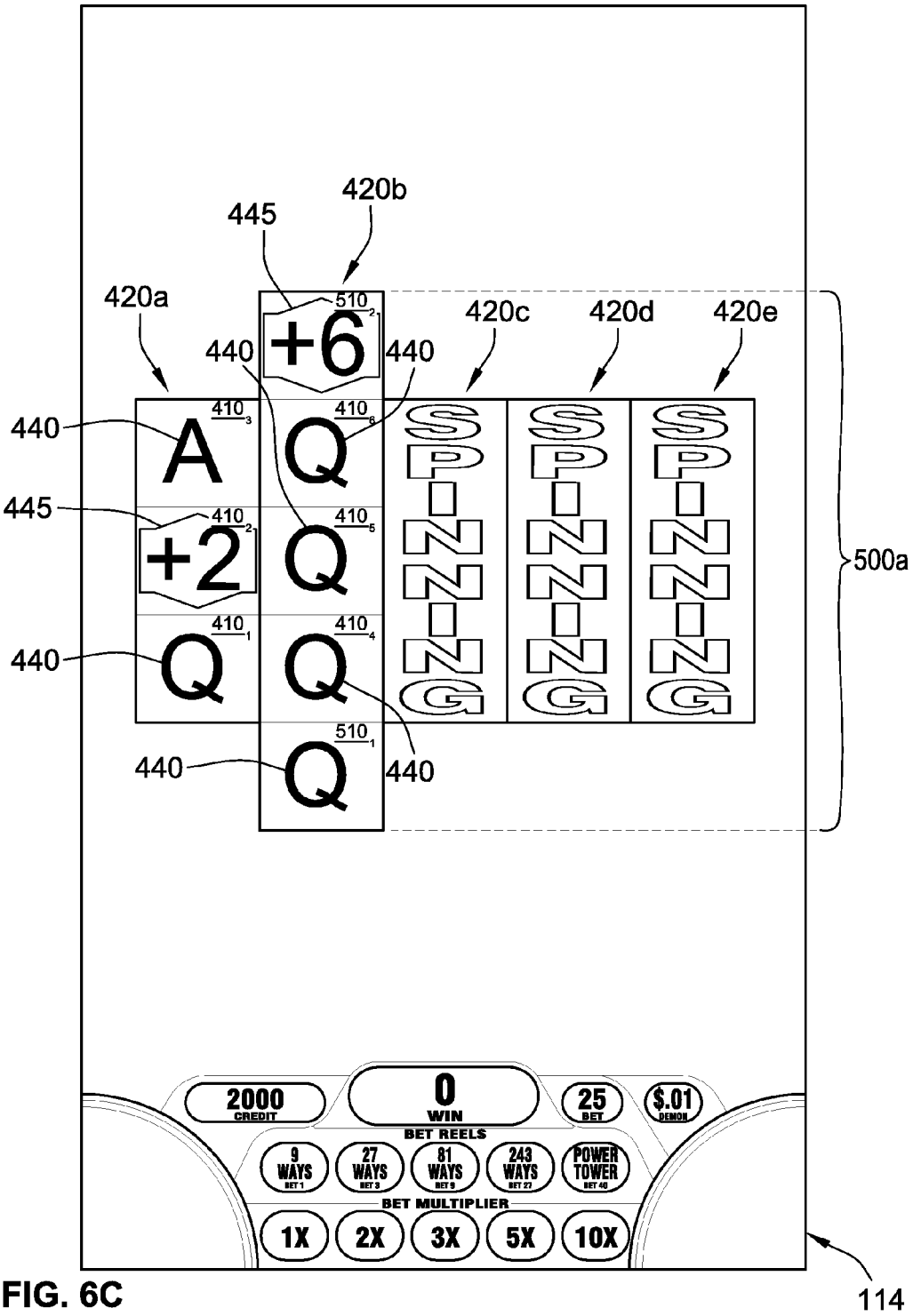

Referring to FIG. 6C, the reel-expansion symbol 445 in the first column 420*a* causes the second column 420*b* to expand and include the two additional symbol positions $\mathbf{510}_1$ and $\mathbf{510}_2$. The two additional symbol positions $\mathbf{510}_1$ and $\mathbf{510}_2$ are added to the base array of symbol positions 400 (FIG. 6B) to create a first intermediate expanded array of symbol positions 500*a*. A first one of the additional symbol positions $510_1$ is positioned below the fourth symbol position $410_4$ and the other of the additional symbol positions $510_2$ is positioned above the sixth symbol position $410_6$; however, both of the additional symbol positions $510_1$ and $510_2$ can be added above, below, and/or in between the symbol positions $410_{4-6}$.

Figure 6D:
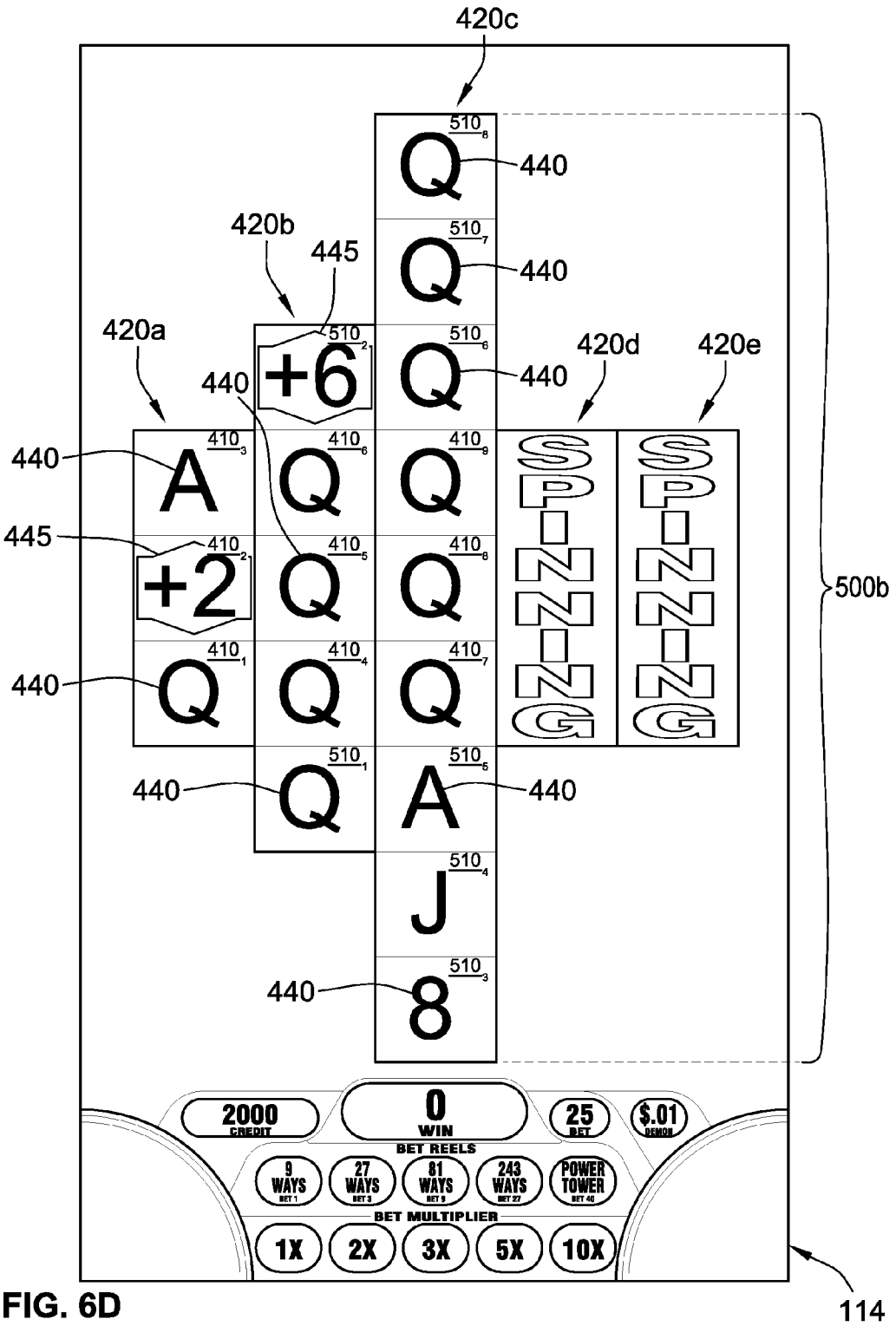

One of the symbols randomly distributed among the symbol positions in the second column 420*b* is a +6 reel-expansion symbol 445. In the same manner as described in reference to the +2 reel-expansion symbol 445, the third column 420*c* is expanded to include six additional symbol positions, as shown in FIG. 6D. FIG. 6D is a screen shot of a second intermediate expanded array of symbol positions 500*b* including the two additional symbol positions $510_1$ and $510_2$ added based on the first reel-expansion symbol 445 in the first column 420*a* and the six additional symbol positions $510_{3-8}$ added based on the second reel-expansion symbol 445 in the second column 420*b*.

Figure 6F:
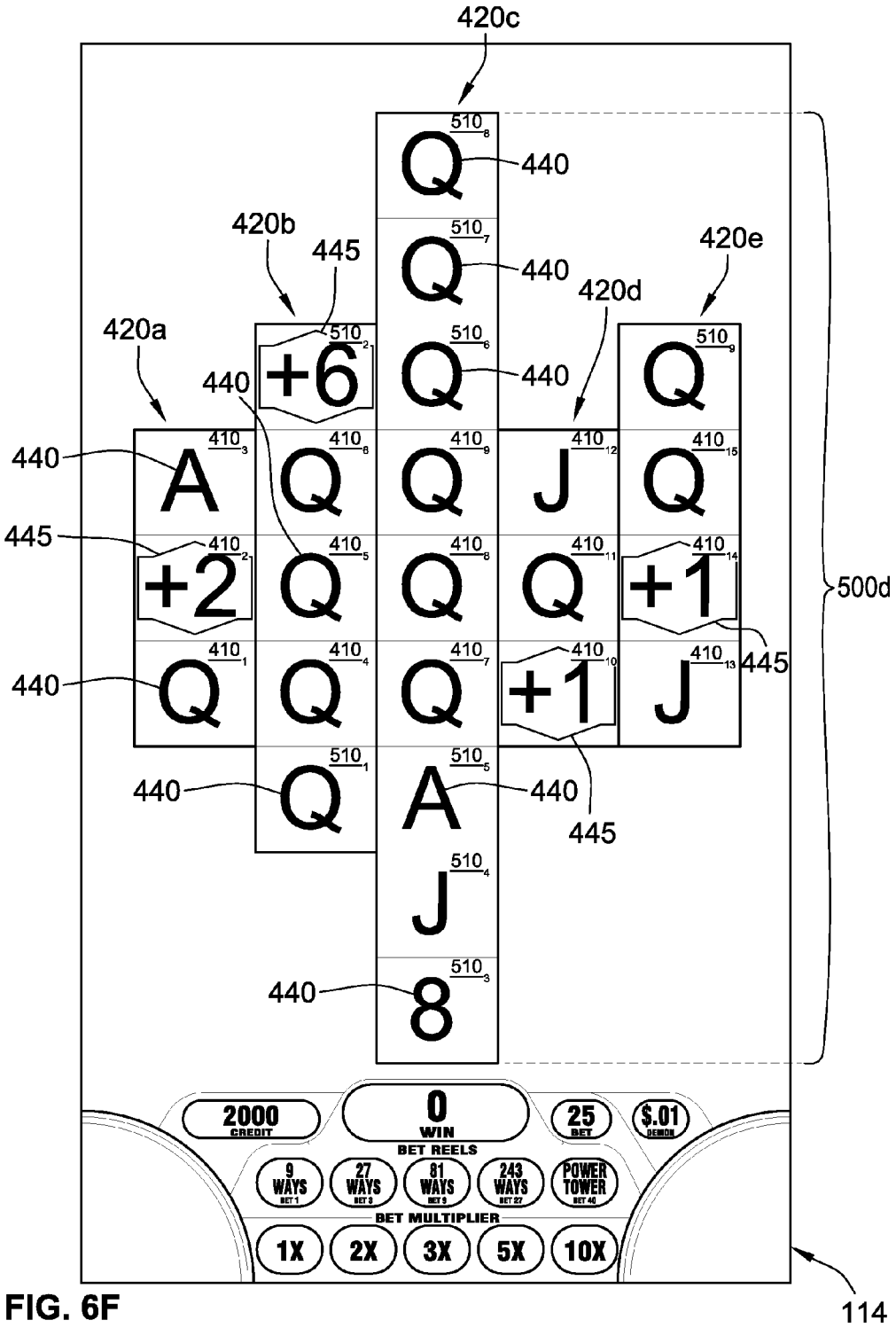

As none of the symbol positions in the third column 420*c* is associated with a reel-expansion symbol, the fourth column 420*d* is not expanded to include any additional symbol positions. Referring to FIG. 6E, a third intermediate expanded array of symbol positions 500*c* includes a +1 reel-expansion symbol 445 in the fourth column 420*d*. In the same manner as described in reference to the +2 and +6 reel-expansion symbols 445, the fifth column 420*e* is expanded to include one additional symbol position, as shown in FIG. 6F. FIG. 6F is a screen shot of a fourth intermediate expanded array of symbol positions 500*d* including the two additional symbol positions $510_1$ and $510_2$ added based on the first reel-expansion symbol 445 in the first column 420*a*, the six additional symbol positions $510_{3-8}$ added based on the second reel-expansion symbol 445 in the second column 420*b*, and the one additional symbol position $510_9$ added based on the third reel-expansion symbol 445 in the fourth column 420*d*.

Figure 6G:
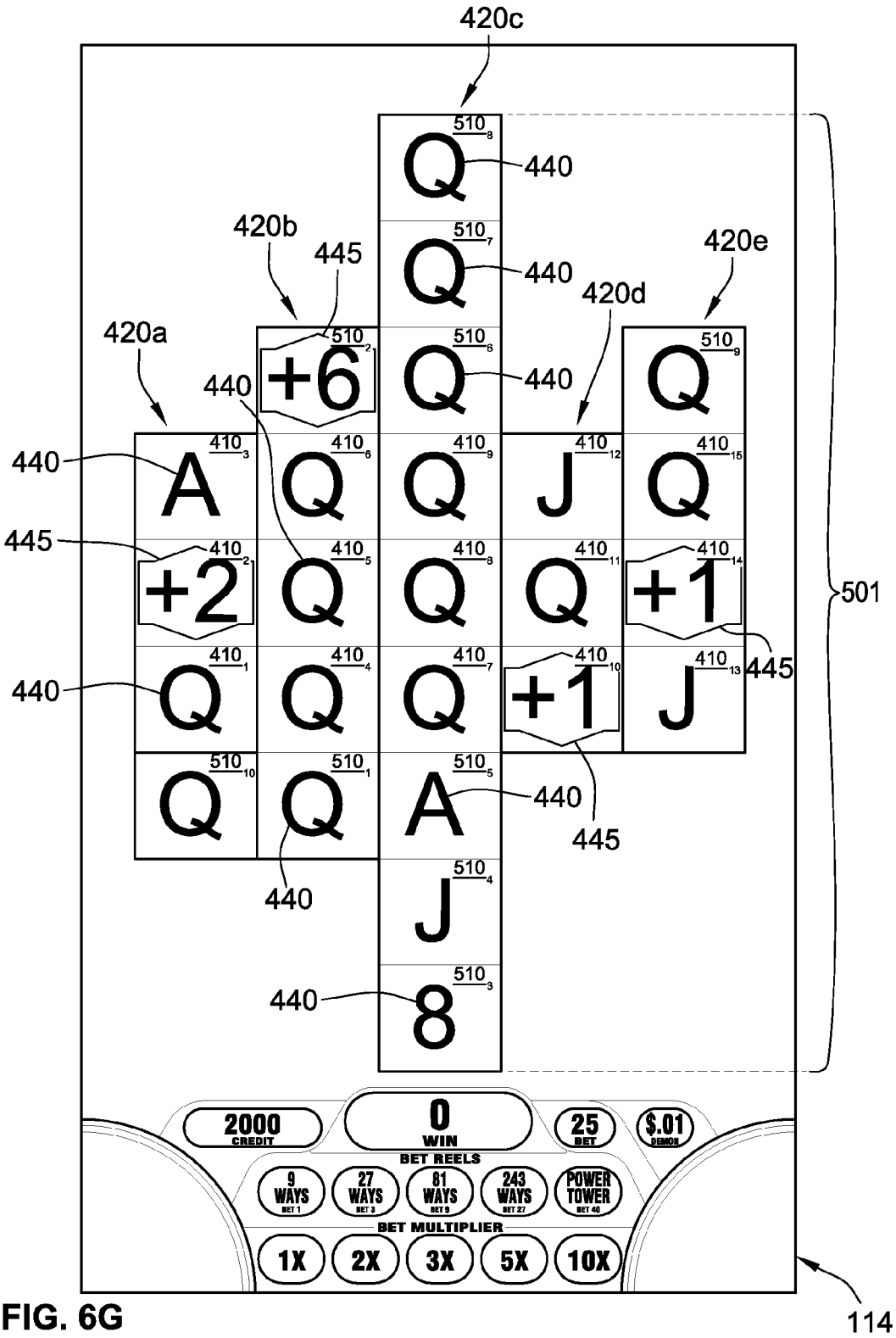

The reel-expansion symbol 445 in the fifth column 420*e* causes the first column 420*a* to expand and include one additional symbol position $510_{10}$. The additional symbol position $510_{10}$ is added to create an expanded array of symbol positions 501, which is shown in FIG. 6G. Alternatively, the +1 reel-expansion symbol included in the fifth column 420*e* can cause any of the columns 420*a-e* to expand.

While the expanding of the columns 420*a-e* is shown and described as occurring one at a time after each previous column stops spinning, expanding of the base array of symbol positions 400 (FIG. 6A) into the expanded array of symbol positions 501 (FIG. 6G) can occur at any time during play of the wagering game, such as, for example, after all of the columns 420*a-e* stop spinning (not shown).

The total number of additional symbol positions $510_{1-10}$ added to the base array of symbol positions 400 (FIG. 6B) to create the expanded array of symbol positions 501 (FIG. 6G) is based on the indicia numbers associated with each of the reel-expansion symbols 445 included in the base array of symbol positions 400 and the intermediate expanded arrays of symbol positions 500*a-d*. In the illustrated example of FIGS. 6A-6G, the indicia number associated with each of the reel-expansion symbols 445 is two, six, one and one, respectively, thus, the expanded array of symbol positions 501 includes ten additional symbol positions $510_{1-10}$ (FIG. 6G).

As the expanded array of symbol positions 501 (FIG. 6G) includes more symbol positions than the base array of symbol positions 400 (FIG. 6A), the expanded array of symbol positions 501 has more ways for a player of the wagering game to win the wagering game and thus provides added excitement to the player. For example, the base array of symbol positions 400 includes 5 columns 420*a-e* with three symbol positions 410 in each column, which has two hundred and forty-three ways to win (3×3×3×3×3=243), assuming a winning outcome must start from the leftmost column 420*a* and must include a single symbol from each of the columns 420*a-e*. However, the expanded array of symbol positions 510 includes 5 columns 520*a-e* with four symbol positions $410_{1-3}$, $510_{10}$ in the first column 420*a*, five symbol positions $410_{4-6}$, $510_{1-2}$ in the second column 420*b*, nine symbol positions $410_{7-9}$, $510_{3-8}$ in the third column 420*c*, three symbol positions $410_{10-12}$ in the fourth column 420*d*, and four symbol positions $410_{13-15}$, $510_9$ in the fifth column 420*e*, which has two thousand one hundred sixty ways to win (4×5×9×3×4=2160), assuming again a winning outcome must start from the leftmost column 420*a* and must include a single symbol from each of the columns 420*a-e*.

Referring generally to FIGS. 6A-6G, a method of conducting a wagering game according to aspects of the present disclosure includes receiving a wager to play the wagering game. The wager can be received via one or more input devices, such as, for example, a card reader or money acceptor. After the wager is received, the gaming terminal 100 displays the base array of symbol positions 400 arranged in the plurality of columns 420*a-e*. The base array of symbol positions 400 can be displayed on the primary display 114 (as shown in FIG. 6A), the secondary display 116 (not shown), or a combination thereof (not shown).

A plurality of symbols 440 are then randomly distributed among the base array of symbol positions 400 such that each of the symbol positions $410_{1-15}$ is associated with one of the plurality of symbols 440. The random distribution can be performed by a random number generator and/or one or more processors. In response to one of the symbol positions $410_{1-15}$ being associated with a reel-expansion symbol (e.g., symbol position $410_2$), the base array of symbol positions 400 (FIG. 6A) is expanded into one of the intermediate expanded arrays of symbol positions 500*a-d* (FIGS. 6C-6F) or the expanded array of symbol positions 501 (FIG. 6G). Then, the expanded array of symbol positions 501 is displayed such that each symbol position in the expanded array of symbol positions 501 is associated with a single one of the symbols 440 or the reel-expansion symbol 445 (e.g., each symbol position contains exactly one symbol therein). A symbol 440 is defined herein as an indicia appearing on the pay table of the wagering game as an element of a potential winning outcome. The reel-expansion symbol 445 can appear on the pay table or act as a blocking symbol (i.e., a symbol that does not appear on the pay table). Alternatively, the reel-expansion symbol 445 can transform into and/or act as a wild symbol.

As shown in FIGS. 4 and 6A and as described above, the base array of symbol positions 200, 400 is a 3×5 matrix of symbol positions $210_{1-15}$, $410_{1-15}$. Alternatively, the base array of symbol positions 200, 400 can be any size matrix of symbol positions, such as, for example, 1×1, 1×2, 2×3, 5×5, 4×5, 10×10, etc.

Although the columns 220*a-e*, 420*a-e* are described above as all spinning together and then stopping sequentially left to right, various other methods of spinning and stopping the individual columns 220*a-e*, 420*a-e* are contemplated. For example, all of the columns 220*a-e*, 420*a-e* can stop spinning at the same time. For another example, the columns 220*a-e*, 420*a-e* can stop spinning right to left or in any random order (i.e., the third column 220*c*, 420*c* stops spinning first and then the fifth column 220*e*, 420*e* etc.). For yet another example, each column can start and stop spinning prior to any other column starting to spin (i.e., only the first column 220*a*, 420*a* starts to spin, then stops and displays its outcome, and then the second column starts to spin, etc.).

Although the columns 220*a-e* and 420*a-e* are described herein as increasing in length to include additional symbol positions, the rows 230*a-c* and 430*a-c* can increase in width to include the additional symbol positions. The rows 230*a-c* and 430*a-c* can increase in width in lieu of or in addition to the columns 220*a-e* and 420*a-e* increasing in height.

In some implementations of the present disclosure, a bonus game or bonus round can be achieved by a player of the wagering game on the gaming terminal 100. Triggering of the bonus game or bonus round can be random, based in part on one or more inputs (e.g., an additional wager by the player), a mystery trigger, time based, rate of play based, community based, any combination thereof, etc.

After the bonus round is triggered, the player of the gaming terminal 100 is awarded a predetermined number of free plays of the wagering game, such as, for example, ten free plays or spins. Alternatively, the player can be awarded a predetermined amount of time (e.g., 30 seconds, 2 minutes, etc.) to play the wagering game for free. During the free plays of the bonus round, any additional symbol positions (e.g., additional symbol positions $\mathbf{310}_{1\text{-}9}$, $\mathbf{510}_{1\text{-}10}$) achieved during one of the previous plays remain in the expanded array of symbol positions 300, 501 for the remaining ones of the free plays of the wagering game during the bonus round.

For example, as shown in FIG. 5C, assuming a bonus triggering event occurred prior to the outcome shown in FIG. 5B, the additional symbol positions $\mathbf{310}_{1\text{-}9}$ remain in the expanded array of symbol positions 300 and are automatically included in the array of symbol positions for the next one of the free plays. Thus, the additional symbol positions $\mathbf{310}_{1\text{-}9}$ are included during the spinning of the columns 220*a-e* in the next play of the bonus round. If one of the symbol positions $\mathbf{210}_{1\text{-}15}$ and $\mathbf{310}_{1\text{-}9}$ in the expanded array of symbol positions 300 is associated with two or more symbols (not shown), then that symbol position will indicate an extent by which the expanded array of symbol positions 300 will further expand for the next free play in the same manner as described above in reference to FIGS. 5A and 5B.

For another example, assuming a bonus triggering event occurred prior to the outcome shown in FIG. 6G, the additional symbol positions $\mathbf{510}_{1\text{-}10}$ remain in the expanded array of symbol positions 501 and are automatically included in the array of symbol positions for the next one of the free plays. Thus, the additional symbol positions $\mathbf{510}_{1\text{-}10}$ are included during the spinning of the columns 420*a-e* in the next play of the bonus round. If one of the symbol positions $\mathbf{410}_{1\text{-}15}$ and $\mathbf{510}_{1\text{-}10}$ in the expanded array of symbol positions 501 is associated with a reel-expansion symbol (not shown), then that symbol position will indicate an extent by which the expanded array of symbol positions 501 will further expand for the next free play in the same manner as described above in reference to FIGS. 6A-6G.

In some implementations of the present disclosure, a wagering game includes a predetermined number (e.g., 2, 4, 7) of different sized arrays of symbol positions that can be implemented during play of the wagering game. During play of such a wagering game, the size of the array of symbol positions can change from a first sized array to a second sized array based on the occurrence of an event (e.g., random, mystery, additional wager, time based, community based, rate of play based, etc.). For example, during the spinning of the columns (i.e., while at least one of the reels or columns is still spinning), the array changes from a first format (e.g., 3×3×3×3×3) to a second format (e.g., 3×7×3×7×3). For another example, after all of the columns stop spinning and the outcome is displayed, the array changes from a first format (e.g., 3×3×3×3) to a second format (e.g., 5×7×5×7×5), wherein each of the additional symbol positions in the second format is associated with a symbol and each of the symbols is evaluated to determine if the outcome of the expanded array (i.e., the 5×7×5×7×5 array of symbol positions) is a winning outcome.

In some implementations of the present disclosure, a base array of symbol positions is, for example, a 3×5 matrix of symbol positions (e.g., the base array of symbol positions 200). After a winning combination is achieved, all of the symbols associated with a winning combination, which are thereby winning symbols, are removed from the base array of symbol positions. The symbols associated with symbol positions above the symbol positions associated with the winning symbols are cascaded downward to fill the vacated symbol positions. Additional symbols that were not viewable prior to the cascading also cascade downward to fill the symbol positions vacated by symbols used to fill the symbol positions of the winning symbols. Additionally, a new row of symbol positions is added on top of the 3×5 matrix during the cascading feature such that an additional row of symbol positions and associated symbols is available for a follow up play of the wagering game using the expanded 4×5 matrix of symbol positions. An award can be achieved for a winning outcome after each play of the wagering game.

In some implementations of the present disclosure, a base array of symbol positions is, for example, a 3×5 matrix of symbol positions (e.g., the base array of symbol positions 200). After a winning combination is achieved, all of the symbols associated with a winning combination, which are thereby winning symbols, are locked in place and an additional row of symbol positions is added to expand the array into an expanded 4×5 array of symbol positions. Symbols are then randomly distributed among the non-winning symbols and the additional symbol positions. The expanded 4×5 array of symbol positions is reevaluated to determine if any of the non-locked symbols form part of a new winning outcome. If so, those non-locked symbols are then also locked and the process repeats until a final play or spin. After the final play, the entire expanded array is evaluated and an award is given to the player for the final array only. Alternatively, an award can be given to the player after each play of the wagering game.

Figure 7A:
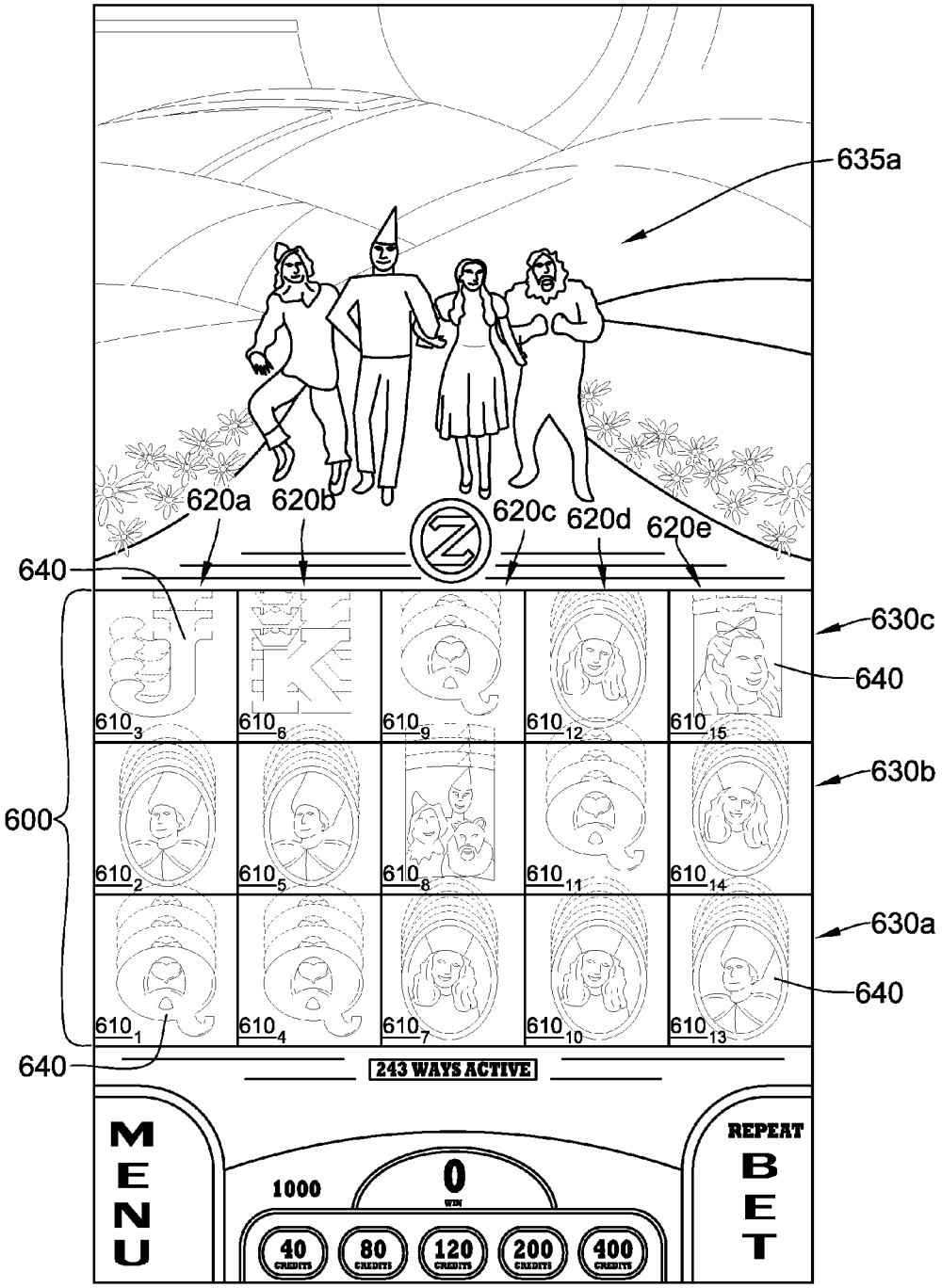
FIGS. 7A-7E are screen shots of a display of the free-standing gaming terminal of FIG. 3 according to various aspects of the present disclosure.

Referring to FIG. 7A, a screen shot from the primary display area 114 illustrates a base array of symbol positions 600 used in conducting a wagering game, which is the same as, or similar to, the base array of symbol positions 200 and 400 described above. Specifically, the base array of symbol positions 600 is a 3×5 matrix of symbol positions $\mathbf{610}_{1\text{-}15}$ arranged in five columns 620*a-e* and three rows 630*a-c* (i.e., 15 symbol positions $\mathbf{610}_{1\text{-}15}$).

At the beginning of a play of the wagering game all of the columns 620*a-e* spin a plurality of symbols 640 and then stop spinning sequentially left to right in the same, or similar, fashion as described above in reference to FIG. 4. Prior to and during the spinning of the columns 620*a-e*, the primary display area 14 and/or the secondary display area 116 displays a first theme or a first set of images 635*a*. For example, as shown in FIG. 7A, the first theme 635*a* is The Wizard of Oz including images of several characters on a yellow brick road.

While the columns 620*a-e* spin, in response to the occurrence of a triggering event, a symbol-duplication or symbolclumping feature is activated and conducted during the play of the wagering game. The triggering event can be random, based at least in part on a player input, based on a wager amount, based on a mystery trigger, symbol based, based on time of play, based on rate of play, etc. Alternatively, the symbol-duplication feature can be outcome based, where one or more symbols in the outcome of a play of the wagering game triggers the symbol-duplication feature. In some aspects of the symbol-duplication feature, the length of the spin is extended. The extended spin length can provided additional time for a theme of the wagering game to visually change as described herein.

Figure 7B:
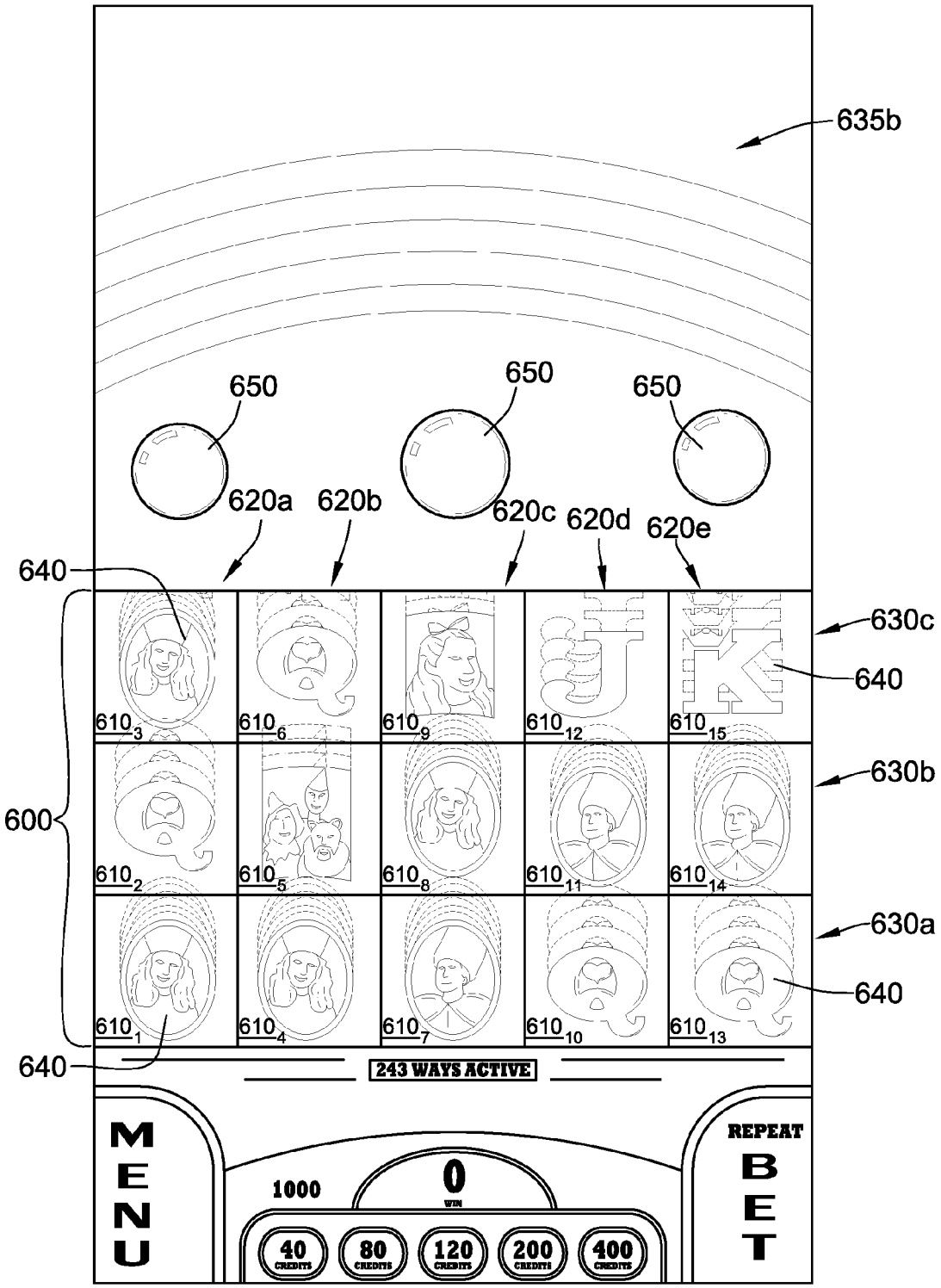

Conducting the symbol-duplication feature occurs during the play of the wagering game and can include changing the displayed theme from the first theme 635*a* to a second theme or a second set of images 635*b* to visually indicate that the symbol-duplication feature has been activated. For example, as shown in FIG. 7B, the symbol-duplication feature has been activated as indicated by the theme change to the second theme 635*b* which includes a rainbow and symbol-selection indicia 650 in lieu of the first theme 635*a* (FIG. 7A) with the characters on the yellow brick road. Various alternative ways of indicating the triggering of the symbol-duplication feature are possible, such as, for example, displaying a message on the primary and/or secondary display 114, 116 (e.g., "Symbol-Duplication Feature Activated"), changing the color of one or more displayed indicia and/or features, changing a reel spin speed, etc.

While three symbol-selection indicia 650 are shown in FIG. 7B, any number of symbol-selection indicia 650 can be included in the symbol-duplication feature (e.g., between 2 and 5, 1, 2, 3, 6, 10, etc.). The number of symbol-selection indicia 650 can be random, based at least in part on a player input, based on a wager amount, symbol based, based on a size of the base array of symbol positions (e.g., for larger arrays more symbol-selection indicia can be provided), etc.

Figure 7C:
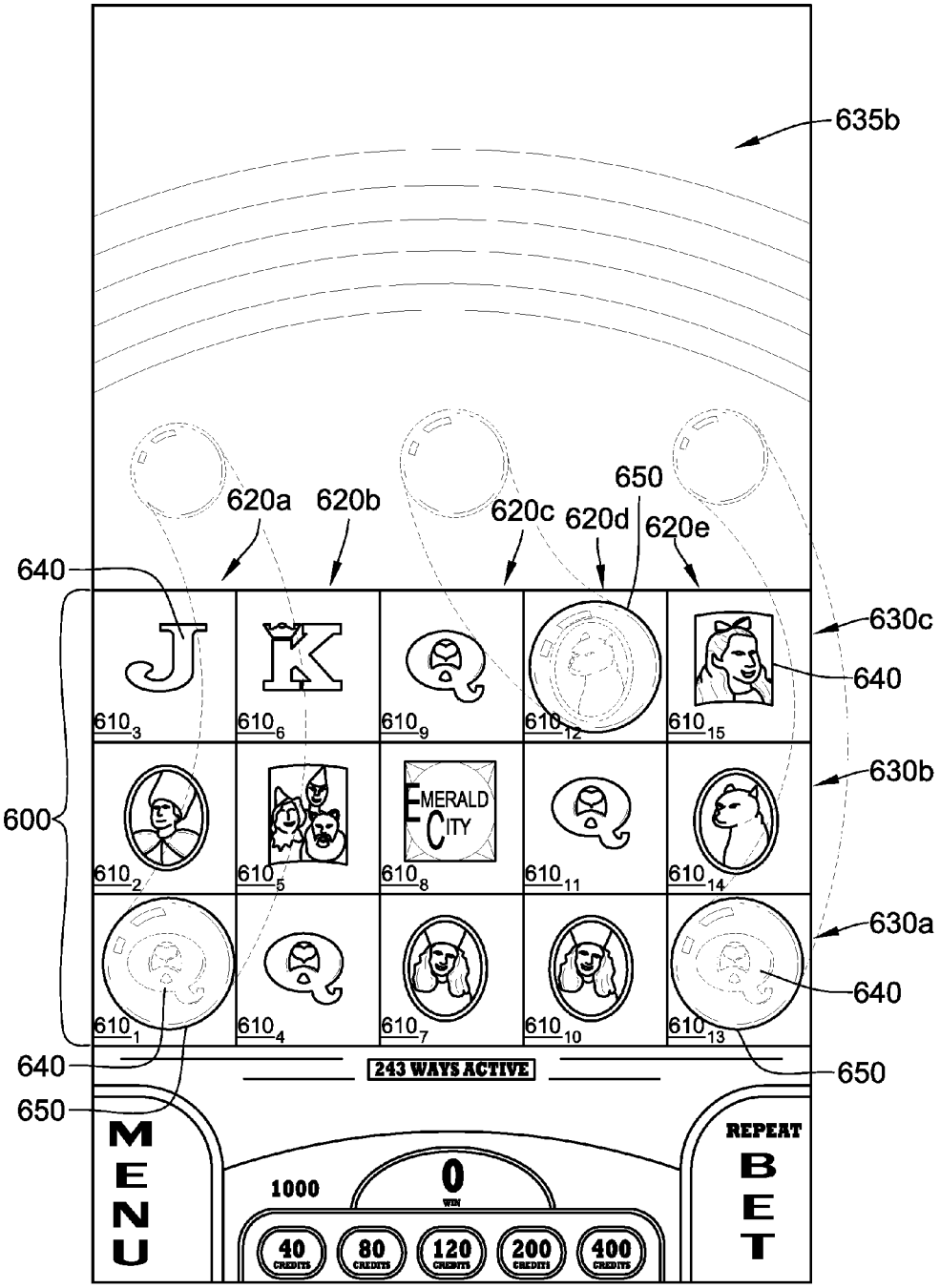

Referring to FIG. 7C, a randomly selected outcome of the play of the wagering game is illustrated as each of the symbol positions $\mathbf{610}_{1\text{-}15}$ is associated with one of the plurality of symbols 640. Further, in response to the outcome being displayed and in response to the symbol-duplication feature being activated, each of the symbol-selection indicia 650 is randomly and visually associated with one of the symbols 640 in respective symbol positions 610. That is, after all of the columns 620*a-e* stop spinning and the random outcome is displayed, each of the symbol-selection indicia 650 is randomly associated with one of the symbols 640 in the displayed outcome.

For example, as shown in FIG. 7C, the first, twelfth, and thirteenth symbol positions $\mathbf{610}_1$, $\mathbf{610}_{12}$, and $\mathbf{610}_{13}$ are each associated with one of the symbol-selection indicia 650 and are thereby duplicating-symbol positions with the associated symbols therein being duplicating symbols. Specifically, as shown in FIG. 7C, a first one of the symbol-selection indicia 650 is associated with and overlays the "Q" symbol 640 in the first symbol position $\mathbf{610}_1$ thereby making the first symbol position $\mathbf{610}_1$ a duplicating symbol position and making the "Q" symbol a duplicating symbol. Similarly, a second one of the symbol-selection indicia 650 is associated with and overlays the "Dog" symbol 640 in the twelfth symbol position $\mathbf{610}_{12}$ thereby making the twelfth symbol position $\mathbf{610}_{12}$ a duplicating symbol position and making the "Dog" symbol a duplicating symbol; and a third one of the symbol-selection indicia 650 is associated with and overlays the "Q" symbol 640 in the thirteenth symbol position $\mathbf{610}_{13}$ thereby making the thirteenth symbol position $\mathbf{610}_{13}$ a duplicating symbol position and making the "Q" symbol a duplicating symbol. While only selected ones of the "Q" and "Dog" symbols 640 are randomly selected to be duplicating symbols as shown in FIG. 7C, any of the other symbols 640 can be randomly selected to be a duplicating symbol (not shown).

Figure 7D:
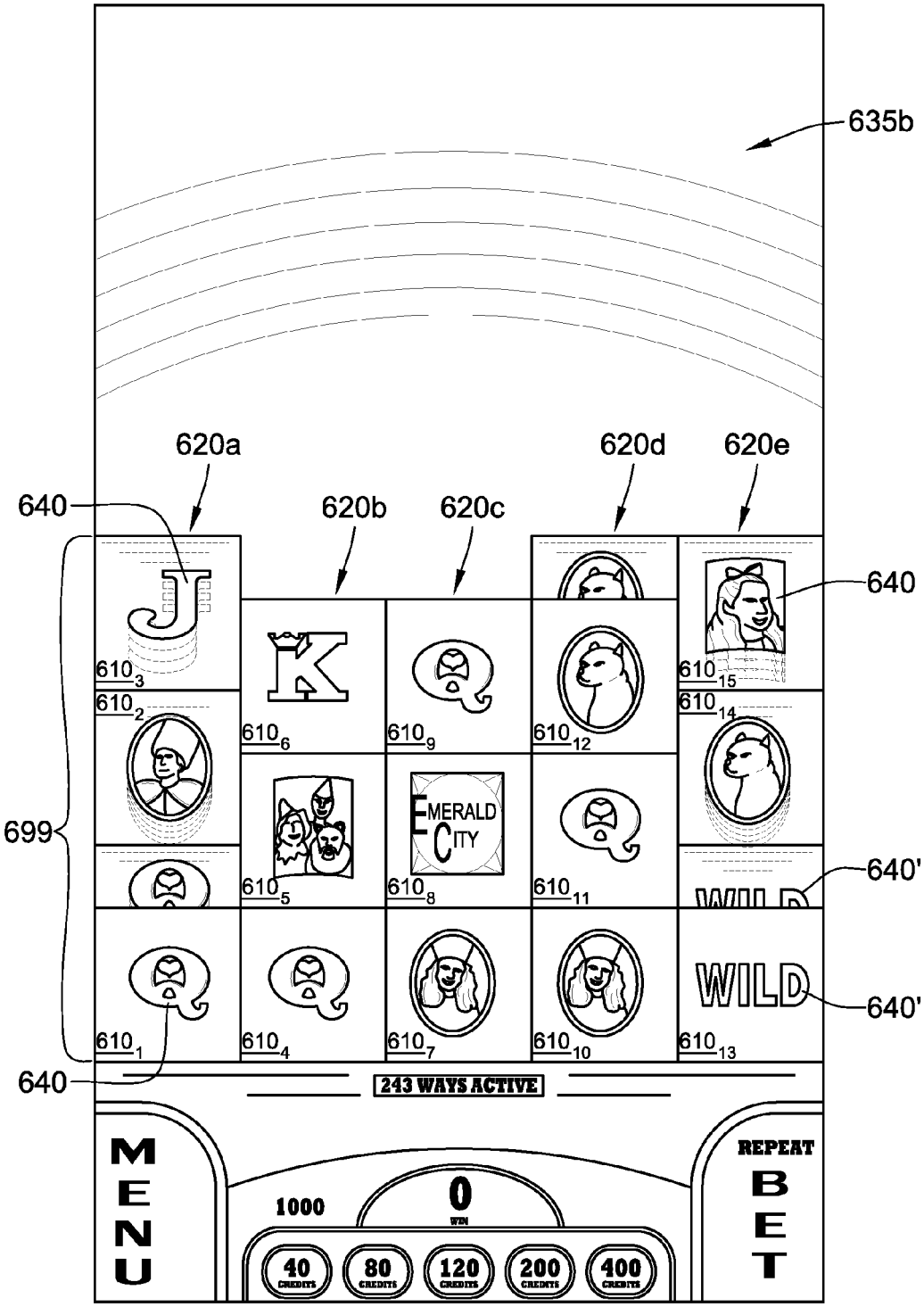
Figure 7E:
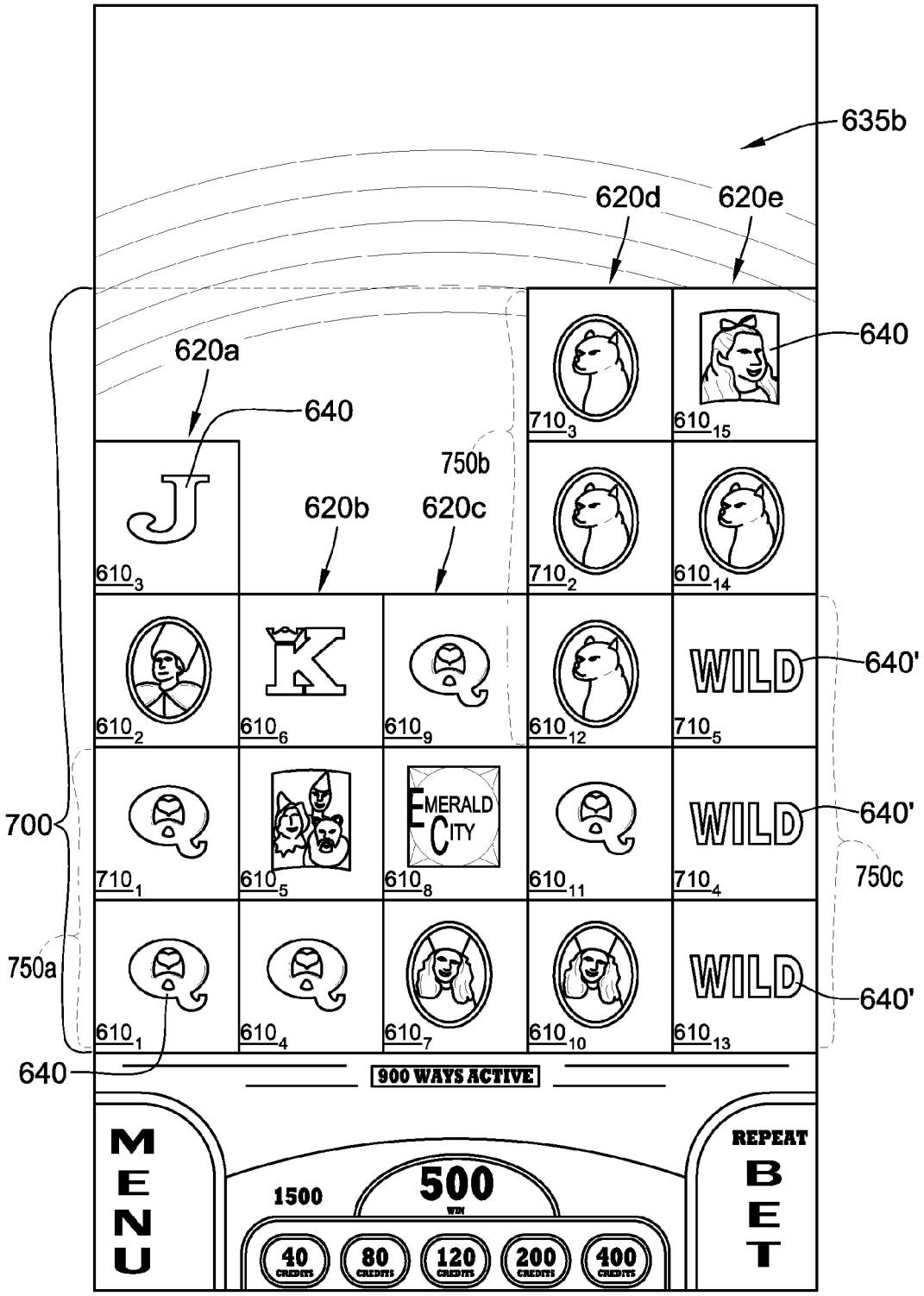

Referring to FIG. 7D, a screenshot is shown illustrating an intermediate expanding array of symbol positions 699 where the base array of symbol positions 600 (FIGS. 7A-7C) is in the process of expanding into the expanded array of symbol positions 700 (FIG. 7E). As shown, the base array of symbol positions 600 (FIGS. 7A-7C) expands into an expanded array of symbol positions 700 (FIG. 7E) to include one or more additional symbol positions $\mathbf{710}_{1\text{-}5}$ (FIG. 7E). Specifically, one or more of the columns 620*a-e* of the base array of symbol positions 600 (FIG. 7C) is expanded to include one or more additional symbol positions $\mathbf{710}_{1\text{-}5}$ (FIG. 7E). The selection of which columns to expand by the symbol-selection indicia 650 can be random and the degree of expansion of each selected column can also be random. That is, in some implementations of the disclosed concepts, the columns 620*a-e* are randomly selected to be expanded and the degree of the expansion of each selected column is random.

For example, as shown in FIG. 7C, the first column 620*a* is randomly selected to be expanded as indicated by the "Q" symbol 640 in the first symbol position $\mathbf{610}_1$ of the first column 620*a* being visually associated with one of the symbol-selection indicia 650. Additionally, as shown in FIG. 7E, the first column 620*a* randomly increased in height by expanding to include one additional symbol position $\mathbf{710}_1$. Specifically, the additional symbol position $\mathbf{710}_1$ is added between the first and second symbol positions $\mathbf{610}_1$ and $\mathbf{610}_2$ causing the symbol positions $\mathbf{610}_2$ and $\mathbf{610}_3$ above the duplicating-symbol position $\mathbf{610}_1$ to be moved and/or translated upward to accommodate the additional symbol position $\mathbf{710}_1$. Alternatively, the additional symbol position $\mathbf{710}_1$ can be added to any other position in the first column 620*a* or any position adjacent to the first symbol position $\mathbf{610}_1$ (e.g., below the first symbol position $\mathbf{610}_1$, above the third symbol position $\mathbf{610}_3$, left of the first symbol position $\mathbf{610}_1$, in the second column 620*b*, etc.).

Following and/or during the expansion of the first column 620*a* to include the one additional symbol position $\mathbf{710}_1$, the "Q" symbol 640 associated with the first symbol position $\mathbf{610}_1$, which is a duplicating symbol, is duplicated and distributed into and/or populated into the adjacent additional symbol position $\mathbf{710}_1$, thereby forming a first clump 750*a* of two "Q" symbols in the first column 620*a*. The term "clump" as used herein refers to at least two like symbols (e.g., two "Q" symbols, three "K" symbols, etc.) being associated with adjacent symbol positions in a column and/or in a row. The clump can include the symbol originally in the outcome and the duplicated copies of that symbol in the adjacent additional symbol positions. As clumps include two or more like symbols, after the expansion and distribution/population of the duplicated symbols, the chances of a winning outcome being achieved is increased, which adds excitement and anticipation for a player of the wagering game including such a symbol-duplicating feature.

In addition to the first column 620*a* expanding in FIGS. 7D and 7E, the fourth and fifth columns 620*d* and 620*e* also were randomly selected to expand via the symbol-selection indicia 650. Specifically, as shown in FIG. 7E, the fourth column 620*d* randomly increased in height by expanding to include two additional symbol positions $\mathbf{710}_{2\text{-}3}$. The additional symbol positions $\mathbf{710}_{2\text{-}3}$ are added above the twelfth symbol position $\mathbf{610}_{12}$. Alternatively, the additional symbol positions $710_{2-3}$ can be added to any other positions in the fourth column 620*d* or any positions adjacent to the twelfth symbol position $610_{12}$ (e.g., below the tenth symbol position $610_{10}$, between the eleventh and twelfth symbol positions $610_{11}$ and $610_{12}$, in the third and/or fifth columns 620*c,e*, etc.). Following and/or during the expansion of the fourth column 620*d* to include the two additional symbol positions $710_{2-3}$, the "Dog" symbol 640 associated with the twelfth symbol position $610_{12}$, which is a duplicating symbol, is duplicated and distributed into and/or populated into the adjacent additional symbol positions $710_{2-3}$, thereby forming a second clump 750*b* of three "Dog" symbols in the fourth column 620*d*.

In addition to each symbol-selection indicia 650 being associated with and covering a symbol 640, each symbol-selection indicia 650 can at least partially visually obscure its associated symbol 640 as shown in FIG. 7C. In some instances, the symbol-selection indicia 650 can further trigger and/or cause a symbol-transforming feature that transforms its associated symbol 640 into a different symbol before the duplicating symbol is duplicated and distributed and/or populated. For example, the third one of the symbol-selection indicia 650 associated with the "Q" symbol 640 in the thirteenth symbol position $610_{13}$ can cause the "Q" symbol 640 (FIG. 7C) to visually transform into a wild symbol 640' (FIG. 7D) before duplicating the transformed wild symbol 640' as shown in FIGS. 7D (partial duplication) and 7E (complete duplication).

As shown in FIG. 7E, the fifth column 620*e* randomly increased in height by expanding to include two additional symbol positions $710_{4-5}$, as shown in FIG. 7E. The additional symbol positions $710_{4-5}$ are between the thirteenth and fourteenth symbol positions $610_{13}$ and $610_{14}$ causing the symbol positions $610_{14}$ and $610_{15}$ above the duplicating-symbol position $610_3$ to be moved and/or translated upward to accommodate the additional symbol positions $710_{4-5}$. Alternatively, the additional symbol positions $710_{4-5}$ can be added to any other positions in the fifth column 620*e* or any position adjacent to the thirteenth symbol position $610_{13}$ (e.g., below the thirteenth symbol position $610_{13}$, above the fifteenth symbol position $610_{15}$, in the fourth column 620*d*, right of the thirteenth symbol position $610_{13}$, etc.). Following and/or during the expansion of the fifth column 620*e* to include the two additional symbol positions $710_{4-5}$, the transformed "Wild" symbol 640' associated with the thirteenth symbol position $610_{13}$, which is a duplicating symbol, is duplicated and distributed into and/or populated into the adjacent additional symbol positions $710_{4-5}$, thereby forming a third clump 750*c* of "Wild" symbols in the fifth column 620*e*.

The expanding of columns and distributing and/or populating of the duplicated symbols can occur at any time during the play of the wagering game. For example, all of the duplicating-symbol positions (e.g., symbol positions $610_1$, $610_{12}$, and $610_{13}$) can be expanded and duplicated together after all of the selected columns expand into the expanded array of symbol positions 700. Alternatively, the first column including a duplicating-symbol position (e.g., the first column 620*a*) can expand and then distribute and/or populate the duplicated symbol(s) in the additional symbol position(s) as described herein prior to the next column including a duplicating-symbol position.

After the duplicating symbols 640 are duplicated and populated into the additional symbol positions $710_{1-5}$ in the expanded array of symbol positions 700, the outcome is evaluated to determine if it is a winning outcome. If a winning outcome is determined, an award is provided to the player of the wagering game (e.g., credits or money). The amount of the provided award is based on a value associated with the winning outcome in a pay table. The outcome of the wagering game can correspond with more than one winning outcome in the pay table and is thereby a multi-winning outcome. In the case of a multi-winning outcome, the amount of the provided award is based on the winning outcome having the largest associated award in the pay table. Alternatively, the amount of the provided award can be the sum (or a percentage thereof) of the awards associated with each of the winning outcomes in the multi-winning outcome.

As the expanded array of symbol positions 700 (FIG. 7E) includes more symbol positions than the base array of symbol positions 600 (FIG. 7A-7C), the expanded array of symbol positions 700 has more ways for a player of the wagering game to win the wagering game and thus provides added excitement to the player. For example, the base array of symbol positions 600 includes 5 columns 620*a-e* with three symbol positions 610 in each column, which has two hundred and forty-three ways to win (3×3×3×3×3=243), assuming a winning outcome must start from the leftmost column 620*a* and must include a single symbol from each of the columns 620*a-e*. However, the expanded array of symbol positions 700 includes 5 columns 620*a-e* with four symbol positions $610_{1-3}$, $710_1$ in the first column 620*a*, three symbol positions $610_{4-6}$ in the second column 620*b*, three symbol positions $610_{7-9}$ in the third column 620*c*, five symbol positions $610_{10-12}$, $710_{2-3}$ in the fourth column 620*d*, and five symbol positions $610_{13-15}$, $710_{4-5}$ in the fifth column 620*e*, which has nine hundred ways to win (4×3×3×5×5=900), assuming again a winning outcome must start from the leftmost column 620*a* and must include a single symbol from each of the columns 620*a-e*.

Referring generally to FIGS. 7A-7E, a method of conducting a wagering game according to aspects of the present disclosure includes receiving a wager to play the wagering game. The wager can be received via one or more input devices, such as, for example, a card reader or money acceptor. After the wager is received, the gaming terminal 100 displays the base array of symbol positions 600 arranged in the plurality of columns 620*a-e*. The base array of symbol positions 600 can be displayed on the primary display 114 (as shown in FIGS. 7A-7C), the secondary display 116 (not shown), or a combination thereof (not shown).

The plurality of symbols 640 are then randomly distributed among the base array of symbol positions 600 such that each of the symbol positions $610_{1-15}$ is associated with one of the plurality of symbols 640 (FIG. 7C). The random distribution can be performed by a random number generator and/or one or more processors. In response to one or more of the symbol positions $610_{1-15}$ being associated with a symbol-selection indicia 650 and is thereby a duplicating-symbol position (e.g., duplicating-symbol position $610_1$), the base array of symbol positions 600 (FIG. 7A-7C) is expanded into the expanded array of symbol positions 700 (FIG. 7E), which includes the additional symbol positions $710_{1-5}$. The duplicating symbols 640 associated with the duplicating-symbol positions are duplicated and distributed and/or populated as described above. Then, the expanded array of symbol positions 700 is displayed such that each symbol position in the expanded array of symbol positions 700 is associated with a single symbol 640 (e.g., each symbol position contains exactly one symbol therein).

Alternatively to the expanding of the base array of symbol positions 600 (FIGS. 7A-7C) into the expanded array of symbol positions 700 (FIG. 7E) occurring after the outcome of the play of the wagering game is displayed, the expanding can occur at any time during play of the wagering game and/or in response to one of the symbol-selection indicia 650 associating with a symbol in a symbol position (not shown) and is thereby a duplicating-symbol position. For example, if the columns stop one at a time left to right, in response to a symbol-selection indicia 650 associating with the "Q" symbol 640 prior to the other columns stopping, the first column 620*a* can expand as described herein prior to one or more of the other columns stopping and displaying its respective outcome of symbols. For another example, a symbol-selection indicia 650 can associate with a symbol position in a column prior to the column stopping to spin, thus, making the selected symbol position a duplicating-symbol position prior to a symbol being associated with the position. In such an example, the additional symbol positions can be added prior to the column stopping to spin.

Each of these embodiments and obvious variations thereof is contemplated as falling within the spirit and scope of the claimed invention, which is set forth in the following claims.

What is claimed is:

1. A method of operating a gaming system, the gaming system including one or more controllers and a gaming machine, the gaming machine primarily used for playing a casino wagering game, the gaming machine including an electronic display and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

in response to the initiating, displaying, on at least one of the one or more electronic display devices, a base array of symbol positions arranged in a plurality of columns;

randomly distributing a plurality of symbols such that each of the symbol positions in the base array of symbol positions is associated with one of the plurality of symbols;

expanding the base array of symbol positions into an expanded array of symbol positions by expanding one of the columns to include one or more additional symbol positions;

distributing a duplicated symbol associated with one of the symbol positions into the one or more additional symbol positions such that the expanded column contains a clump of the duplicated symbol;

displaying, on at least one of the one or more electronic display devices, the expanded array of symbol positions; and receiving, via at least one of the one or more electronic input devices, a payout input that initiates a payout from the credit balance.

2. The method of claim 1, wherein the expanding includes randomly determining the number of additional symbol positions to be included in the expanded array of symbol positions.

3. The method of claim 1, further comprising, prior to the expanding, triggering the expanding of the base array of symbol positions independent of the distributed symbols in the base array of symbol positions.

4. The method of claim 1, further comprising transforming the duplicated symbol into a wild symbol such that the clump of the duplicated symbol is a clump of wild symbols.

5. The method of claim 1, wherein the clump includes at least two of the distributed duplicated symbols being associated with adjacent ones of the additional symbol positions in the expanded column.

6. The method of claim 1, wherein the duplicated symbol is duplicated from one of the symbols in the expanded one of the columns prior to the expanding.

7. The method of claim 1, further comprising, prior to the distributing the duplicated symbol, visually duplicating the duplicated symbol.

8. The method of claim 1, wherein the expanding the base array of symbol positions into the expanded array of symbol positions includes expanding two or more of the columns such that each expanded column includes one or more additional symbol positions.

9. The method of claim 8, further comprising, for each of the expanded columns, the distributing the duplicated symbol includes distributing a respective duplicated symbol into each additional symbol position such that each expanded column contains a respective clump of the respective duplicated symbol.

10. The method of claim 1, further comprising:

evaluating the plurality of symbols in the expanded array of symbol positions to determine if a winning symbol combination is present;

determining that a winning symbol combination is present, and in response to the determining, providing an award for the determined winning symbol combination.

11. The method of claim 1, wherein the base array of symbol positions is formed by a plurality of symbol-bearing reels, each of the columns being occupied by a single one of the reels.

12. A method of operating a gaming system, the gaming system including one or more controllers and a gaming machine, the gaming machine primarily used for playing a casino wagering game, the gaming machine including an electronic display and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

in response to the initiating, displaying, on at least one of the one or more electronic display devices, a base array of symbol positions arranged in a plurality of columns;

randomly distributing a plurality of symbols such that each of the symbol positions in the base array of symbol positions is associated with one of the plurality of symbols;

expanding the base array of symbol positions into an expanded array of symbol positions by expanding at least one of the columns to include one or more additional symbol positions;

for each expanded column, populating each of the one or more additional symbol positions with a duplicated symbol that is associated with one of the symbol positions of the respective expanded column such that the expanded column contains a clump of the duplicated symbol;

displaying, on at least one of the one or more electronic display devices, the expanded array of symbol positions; and receiving, via at least one of the one or more electronic input devices, a payout input that initiates a payout from the credit balance.

13. The method of claim 12, wherein the expanding includes randomly determining the number of additional symbol positions to be included in each of the expanded columns in the expanded array of symbol positions.

14. The method of claim 12, further comprising, prior to the expanding, triggering the expanding of the base array of symbol positions independent of the distributed symbols in the base array of symbol positions.

15. The method of claim 12, further comprising for a first expanded column, transforming the duplicated symbol into a wild symbol such that the clump of the duplicated symbol in the first expanded column is a clump of wild symbols.

16. The method of claim 12, wherein for each expanded column, the respective clump includes at least two of the populated duplicated symbols being associated with adjacent ones of the additional symbol positions in the respective expanded column.

17. The method of claim 12, wherein the expanding the base array of symbol positions into the expanded array of symbol positions includes expanding two or more of the columns such that each expanded column includes one or more additional symbol positions.

18. The method of claim 17, further comprising, for each of the expanded columns, the populating includes populating a respective duplicated symbol into each additional symbol position such that each expanded column contains a respective clump of the respective duplicated symbol.

19. The method of claim 18, wherein the respective duplicated symbol for each expanded column is a different duplicated symbol.

20. The method of claim 12, further comprising:

evaluating the plurality of symbols in the expanded array of symbol positions to determine if a winning symbol combination is present;

determining that a winning symbol combination is present, and in response to the determining, providing an award for the determined winning symbol combination.

21. The method of claim 12, wherein the base array of symbol positions is formed by a plurality of symbol-bearing reels, each of the columns being occupied by a single one of the reels.

22. A gaming system, comprising:

a gaming machine primarily used for to playing at least one casino wagering game, the gaming machine including an electronic display device and one or more electronic input devices; and one or more controllers configured to:

detect, via at least one of the one or more electronic input devices, a physical item associated with a monetary value that establishes a credit balance;

initiate the casino wagering game in response to an input indicative of a wager covered by the credit balance;

display, on the display device, a base array of symbol positions arranged in a plurality of columns;

randomly distribute a plurality of symbols such that each of the symbol positions in the base array of symbol positions is associated with one of the plurality of symbols;

expand the base array of symbol positions into an expanded array of symbol positions by expanding at least one of the columns to include one or more additional symbol positions;

for each expanded column, populate each of the one or more additional symbol positions with a duplicated symbol that is associated with one of the symbol positions of the respective expanded column such that the expanded column contains a clump of the duplicated symbol;

display, on the display device, the expanded array of symbol positions; and receive, via at least one of the one or more electronic input devices, a payout input that initiates a payout from the credit balance.

23. The gaming system of claim 22, wherein the expanding includes randomly determining the number of additional symbol positions to be included in each of the expanded columns in the expanded array of symbol positions.

24. The gaming system of claim 22, wherein the one or more controllers is further configured to trigger the expanding of the base array of symbol positions independent of the distributed symbols in the base array of symbol positions.

25. The gaming system of claim 22, wherein the one or more controllers is further configured to transform the duplicated symbol into a wild symbol such that the clump of the duplicated symbol is a clump of wild symbols.

* * * * *